US007292798B2

(12) United States Patent
Furukawa et al.

(10) Patent No.: US 7,292,798 B2
(45) **Date of Patent: *Nov. 6, 2007**

(54) IMAGE-FORMING DEVICE THAT SETS IMAGE-FORMING CONDITIONS

(75) Inventors: Toshio Furukawa, Nagoya (JP); Kenjiro Nishiwaki, Nagoya (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 210 days.

(21) Appl. No.: 11/102,684

(22) Filed: Apr. 11, 2005

(65) Prior Publication Data

US 2005/0249515 A1 Nov. 10, 2005

(30) Foreign Application Priority Data

Apr. 12, 2004 (JP) ..... 2004-116870
Sep. 30, 2004 (JP) ..... 2004-288651

(51) Int. Cl.
*G03G 15/00* (2006.01)

(52) U.S. Cl. ..... 399/49; 399/46

(58) Field of Classification Search ..... 399/46, 399/49, 50, 51, 53, 55, 66
See application file for complete search history.

(56) References Cited

U.S. PATENT DOCUMENTS 5,307,119 A 4/1994 Folkins et al.

FOREIGN PATENT DOCUMENTS

| | | |
|---|---|---|
| EP | 0 793 148 A2 | 9/1997 |
| JP | A-05-307303 | 11/1993 |
| JP | A-07-1408848 | 6/1995 |
| JP | A-08-123153 | 5/1996 |
| JP | A-10-186877 | 7/1998 |
| JP | A-2003-233253 | 8/2003 |

*Primary Examiner*—Hoang Ngo
(74) *Attorney, Agent, or Firm*—Oliff & Berridge, PLC

(57) ABSTRACT

A control section sets the transfer bias level applied between a transfer roller and a photosensitive drum in the printer to a "ghost generation level." The control section forms a test pattern on the recording medium by applying a transfer bias set to the ghost generation level in order to transfer a toner image onto the recording medium. A density sensor detects the density of the toner image deposited in a non-image-forming region when the test pattern is formed. The control section estimates a transfer bias level, at which ghosts will not occur, based on the ghost generation level and the density level of the toner image in the non-image-forming region, and sets this estimated value as the transfer bias level for forming images.

42 Claims, 19 Drawing Sheets

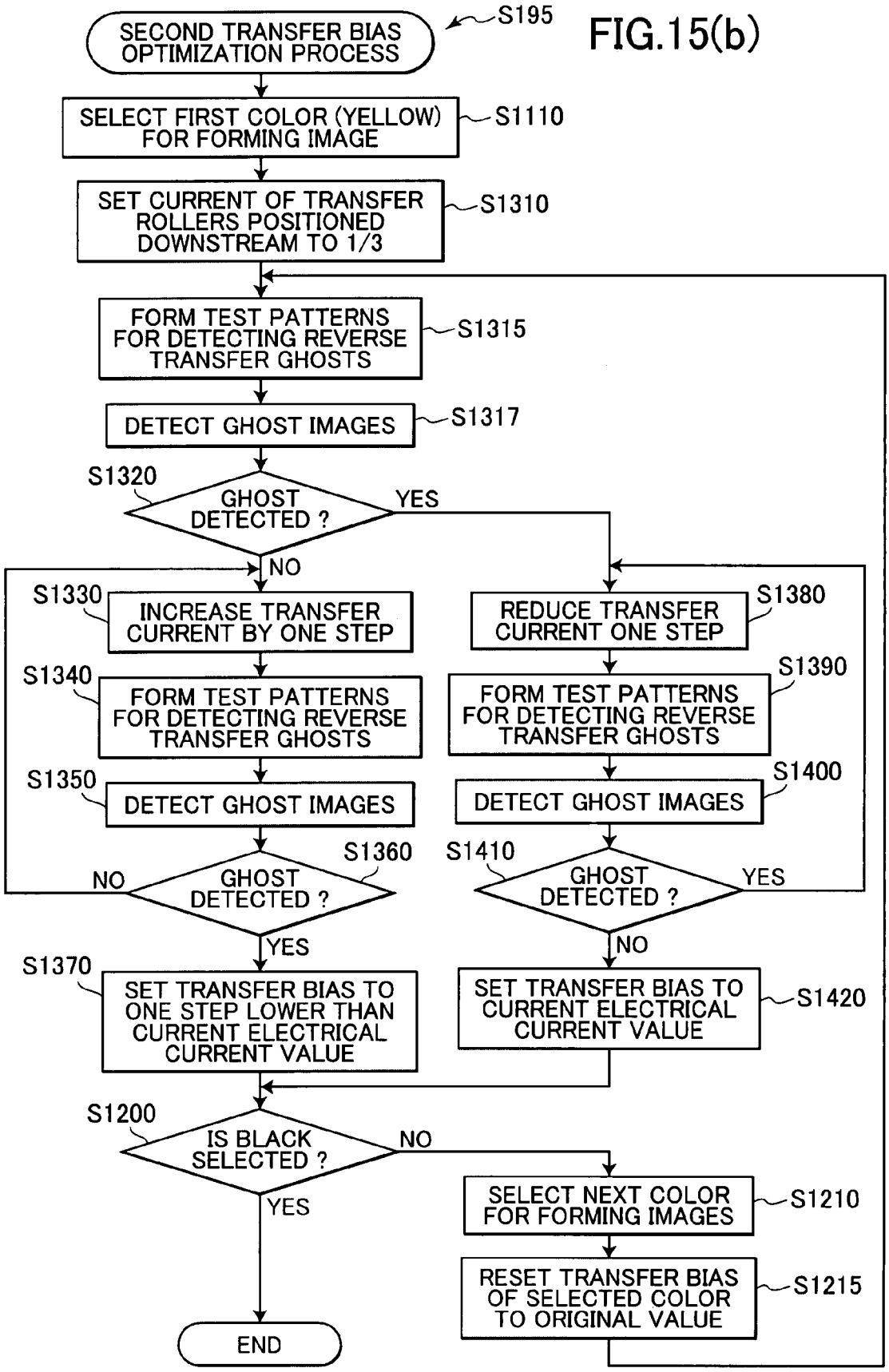
FIG.15(b)
SECOND TRANSFER BIAS OPTIMIZATION PROCESS
S195
SELECT FIRST COLOR (YELLOW) FOR FORMING IMAGE
S1110
SET CURRENT OF TRANSFER ROLLERS POSITIONED DOWNSTREAM TO 1/3
S1310
FORM TEST PATTERNS FOR DETECTING REVERSE TRANSFER GHOSTS
S1315
DETECT GHOST IMAGES
S1317
S1320
GHOST DETECTED ?
YES
NO
S1330
INCREASE TRANSFER CURRENT BY ONE STEP
S1340
FORM TEST PATTERNS FOR DETECTING REVERSE TRANSFER GHOSTS
S1350
DETECT GHOST IMAGES
S1360
GHOST DETECTED ?
NO
YES
S1370
SET TRANSFER BIAS TO ONE STEP LOWER THAN CURRENT ELECTRICAL CURRENT VALUE
S1380
REDUCE TRANSFER CURRENT ONE STEP
S1390
FORM TEST PATTERNS FOR DETECTING REVERSE TRANSFER GHOSTS
S1400
DETECT GHOST IMAGES
S1410
GHOST DETECTED ?
YES
NO
S1420
SET TRANSFER BIAS TO CURRENT ELECTRICAL CURRENT VALUE
S1200
IS BLACK SELECTED ?
NO
YES
S1210
SELECT NEXT COLOR FOR FORMING IMAGES
S1215
RESET TRANSFER BIAS OF SELECTED COLOR TO ORIGINAL VALUE
END

IMAGE-FORMING DEVICE THAT SETS IMAGE-FORMING CONDITIONS

BACKGROUND OF THE INVENTION

1. Field of the Invention

The present invention relates to an image-forming device that forms images by developing electrostatic latent images formed on a photosensitive member.

2. Description of Related Art

There are well known image-forming devices of a type that form images on paper in a manner described below. The conventional image-forming devices first form electrostatic latent images on a photosensitive member, produce a visible image by developing the latent image with toner, and transfer the developed, visible image onto the paper one such image-forming device disclosed in Japanese unexamined patent application publication No. 2003-233253 is provided with a sensor for detecting toner left on the photosensitive member after the developed image has been transferred onto the paper. When the sensor detects toner left on the surface of the photosensitive member after the transfer, the image-forming device applies a controlled bias to the developing roller (developing bias) to recover the toner left after transfer according to a simultaneous developing and cleaning method. This method improves the efficiency of recovering toner left after transfer, preventing the generation of ghost images in subsequent transfers when toner is transferred to areas of the paper at which images should not be formed.

SUMMARY OF THE INVENTION

However, since the density of toner left after transfer is typically low, the sensor provided in the image-forming device described above will not likely be able to detect the existence of toner left after transfer with accuracy when measuring the density of toner on the surface of the photosensitive member, particularly if the color tone on the surface of the photosensitive member changes through extended use.

In view of the foregoing, it is an object of the present invention to provide an image-forming device that forms images by developing electrostatic latent images formed on a photosensitive member, while reliably preventing the generation of ghost images.

In order to attain the above and other objects, the present invention provides an image-forming device including: a conveying member; an image-forming unit: and a control unit. The conveying member conveys a recording medium in a relative movement direction with respect to an image-forming unit. The image-forming unit performs an image-forming operation. The image-forming unit includes: a photosensitive member; a charging unit that charges the photosensitive member; an exposing unit that forms an electrostatic latent image on the photosensitive member; a developing unit that develops the electrostatic latent image on the photosensitive member into a visible developer image by using a developer agent on the photosensitive member; and a transferring unit that transfers the developer image from the photosensitive member to a transfer member at a predetermined transfer position, the transfer member being either one of the recording medium and the conveying, member The control unit performs an operation to determine image-forming conditions. The control unit includes: a test pattern forming unit; a ghost image detecting unit; and an image-forming condition setting unit. The test pattern forming unit forms a developer image of a test pattern on the transfer member by controlling the image-forming unit to perform an image forming operation to form an electrostatic latent image of the test pattern at a part of the photosensitive member, to develop the electrostatic latent image of the test pattern into a visible developer image of the test pattern, and to transfer the developer image of the test pattern onto the transfer member at its test-image-forming region, a non-test-image-forming region being defined on the transfer member at a location that is different from the test-image-forming region. The ghost image detecting unit detects at least a part of the non-test-image-forming region of the transfer member. The image-forming condition setting unit sets image-forming conditions for at least one of the charging unit, the exposing unit, the developing unit, and the transferring unit based on detection results by the ghost image detecting unit.

According to another aspect, the present invention provides an image-forming device including: an image-forming unit; a test pattern forming; a developer existence detecting unit; and an image-forming condition setting unit. The image-forming unit includes; a photosensitive member with an endless configuration having a predetermined circumference; a charging unit that charges the photosensitive member; an exposing unit that forms an electrostatic latent image on the photosensitive member; a developing unit that develops the electrostatic latent image on the photosensitive member into a visible developer image; and a transferring unit that transfers the developer image onto a transfer member that moves in a relative movement direction with respect to the rotational direction of the photosensitive member at a predetermined transfer position. The test pattern forming unit uses the image-forming unit to form a developer image of test patterns on the photosensitive member. The developer existence detecting unit detects the existence of developer on the photosensitive member after the developer image of the test patterns has been transferred from the photosensitive member to the transfer member. The image-forming condition setting unit sets image-forming conditions for at least one of the charging unit, the exposing unit, the developing unit, and the transferring unit based on detection results by the developer existence detecting unit. The test pattern forming unit periodically forms a plurality of test patterns arranged in the relative movement direction at a predetermined interval. The image-forming condition setting unit determines that developer exists on the photosensitive member when the developer existence detecting unit detects the developer at a period matching the test pattern forming interval.

BRIEF DESCRIPTION OF THE DRAWINGS

The above and other objects, features and advantages of the invention will become more apparent from reading the following description of the preferred embodiments taken in connection with the accompanying drawings in which:

FIG. 3 is an explanatory diagram showing a test pattern for detecting ghost images and a ghost detecting position;

FIG. 10(*b*) is a graph illustrating another example of the relationship between the transfer current and the density of ghosts left after transfer;

FIG. 11(*b*) is a graph illustrating another example of the relationship between the transfer current and the density of reverse transfer ghosts;

FIG. 12(*b*) illustrates an example of a table listing up a plurality of maximum transfer currents corresponding to a plurality of combinations of the transfer current and the density of reverse transfer ghosts;

FIG. 15(*b*) is a flowchart illustrating steps in a second transfer bias optimization process in the transfer bias setting process of FIG. 14;

FIG. 16(*b*) is an explanatory diagram showing a test pattern used for detecting magenta toner left after transfer;

FIG. 16(*c*) is an explanatory diagram showing a test pattern used for detecting cyan toner left after transfer;

FIG. 16(*d*) is an-explanatory diagram showing a test pattern used for detecting black toner left after transfer;

FIG. 17(*b*) is an explanatory diagram showing another example of a test pattern used for detecting reverse transfer toner;

DETAILED DESCRIPTION OF THE PREFERRED EMBODIMENTS

Figure 1:
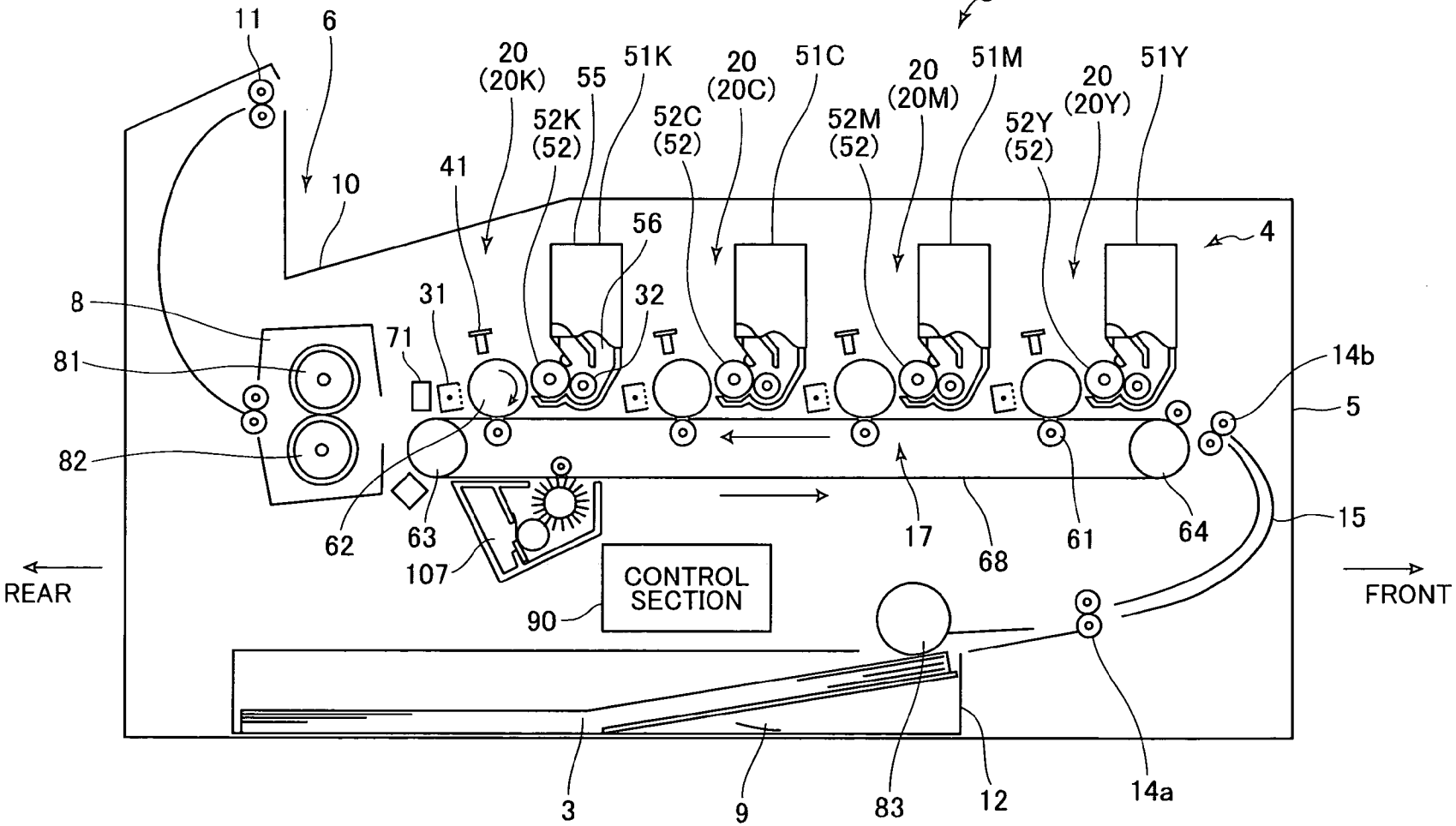
FIG. 1 is a side cross-sectional view showing a printer according to a first embodiment of the present invention.

An image-forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image-forming device is disposed in an orientation in which it is intended to be used.

First Embodiment

FIG. 1 is a cross-sectional view showing the general construction of a printer 1 according to a first embodiment of the present invention.

As shown in FIG. 1, the printer 1 is a tandem color laser printer having four image-forming units 20 described later that are arranged rear-to-front in a horizontal direction. The printer 1 also includes a main casing 5 in which are provided a paper feeding unit 9 for feeding a recording paper 3, an image-forming section 4 for forming images on sheets of the paper 3 that are supplied by the paper feeding unit 9, a paper discharge section 6 for discharging the paper 3 after the image-forming section 4 has formed images thereon, and a control section 90 for controlling operations of the printer 1.

The paper feeding unit 9 is disposed in the bottom section of the main casing 5 and includes a paper tray 12 that is detachably mounted in the main casing 5 through the front side thereof, a feeding roller 83 disposed above the front end of the paper tray 12, and first and second pairs of conveying rollers 14*a* and 14*b* disposed above the feeding roller 83 and on the downstream side of the feeding roller 83 with respect to the direction that the paper 3 is conveyed. (Hereinafter, the downstream side with respect to the conveying direction of the paper 3 will simply be referred to as the "downstream side" and the upstream side with respect to the conveying direction of the paper 3 will simply be referred to as the "upstream side.")

Sheets of the paper 3 are stacked in the paper tray 12. The topmost sheets of the paper 3 are supplied toward the first pair of conveying rollers 14*a* one sheet at a time by the rotation of the feeding roller 83. A guide member 15 is provided between the first and second pairs of conveying rollers 14*a* and 14*b*. The guide member 15 angles upward from the first pair of conveying rollers 14*a* toward the front of the printer 1 and curves back toward the rear of the printer 1 before reaching the second pair of conveying rollers 14. Hence, a sheet of paper 3 supplied by the feeding roller 83 is conveyed by the first pair of conveying rollers 14*a*, and is guided along the guide member 15 toward the second pair of conveying rollers 14*b*. The second pair of conveying rollers 14*b* transfer the sheet of paper 3 to a sequence of transfer positions between a conveying belt 68 and photosensitive drums 62 described later.

The image-forming section 4 is disposed in the center area of the main casing 5 and includes four image-forming units 20 (20Y, 20M, 20C, and 20K) for forming images, a transfer section 17 for transferring images formed by the image-forming units 20 onto the paper 3, and a fixing section 8 for fixing the image transferred onto the paper 3 to the paper 3 using heat and pressure.

Each image-forming unit 20 (20Y, 20M, 20C, and 20K) includes the photosensitive drum 62 and, around the periphery of the photosensitive drum 62, a charger 31 for electrically charging the photosensitive drum 62, a scanning unit 41 for forming electrostatic latent images on the photosensitive drum 62, and a developer cartridge 51 (51Y, 51M, 51C, 51K) for depositing toner on the photosensitive drum 62 to form a toner image.

The charger 31 is a positive charge Scorotron type charger, for example. This type of charger generates a corona discharge from a charging wire formed of tungsten or the like to apply a uniform charge of positive polarity (+700 volts, in this example) over the entire surface of the photosensitive drum 62.

The scanning unit 41 includes: a laser generator that generates laser light for forming electrostatic latent images on the surface of the photosensitive drum 62; lenses; and the like (these components are not shown in the drawings). In this scanning unit 41, the laser-generator irradiates laser light that is scanned over the photosensitive drum 62 to form electrostatic latent images thereon. In this example, the potential of the irradiated portion of the photosensitive drum 62 drops from the original level of +700 volts to about +200 volts, thereby forming an electrostatic latent image.

The developer cartridge 51 (51Y, 51M, 51C, 51K) includes a developer casing 55 housing a toner hopper 56, a supply roller 32, and a developing roller 52 (52Y, 52M, 52C, 52K). The toner hopper 56 is configured of the space inside the developer casing 55. The toner hopper 56 of each image-forming unit 20 accommodates toner in one of the colors yellow (Y), magenta (M), cyan (C), and black (K).

In other words, the four developer cartridges 51 described above include a developer cartridge 51Y accommodating yellow toner in the toner hopper 56, a developer cartridge 51M accommodating magenta toner in the toner hopper 56, a developer cartridge 51C accommodating cyan toner in the toner hopper 56, and a developer cartridge 51K accommodating black toner in the toner hopper 56.

The supply roller 32 is disposed diagonally downward and to the rear of the toner hopper 56. The supply roller 32 includes a metal roller shaft covered with a roller portion formed of a conductive sponge member. The supply roller 32 is rotatably supported so as to move in a direction opposite that of the developing roller 52 at a nip part where the supply roller 32 contacts the developing roller 52.

The developing roller 52 is rotatably disposed below the supply roller 32 and in contact with the same. The developing roller 52 includes a metal roller shaft covered by a roller portion formed of a resilient member, such as a conductive rubber material. The developing roller 52 is applied with a developing bias of +500 volts, in this example.

The transfer section 17 is disposed in the main casing 5 on the opposite side from the developer cartridges 51 and opposes the photosensitive drums 62. The transfer section 17 includes a conveyer belt drive roller 63, a conveyer belt follow roller 64, the endless belt type conveying belt 68, and transfer rollers 61.

A density sensor 71 is disposed near the conveyer belt drive roller 63 for measuring densities on the paper 3 being conveyed on top of the conveying belt 68.

Figure 2:
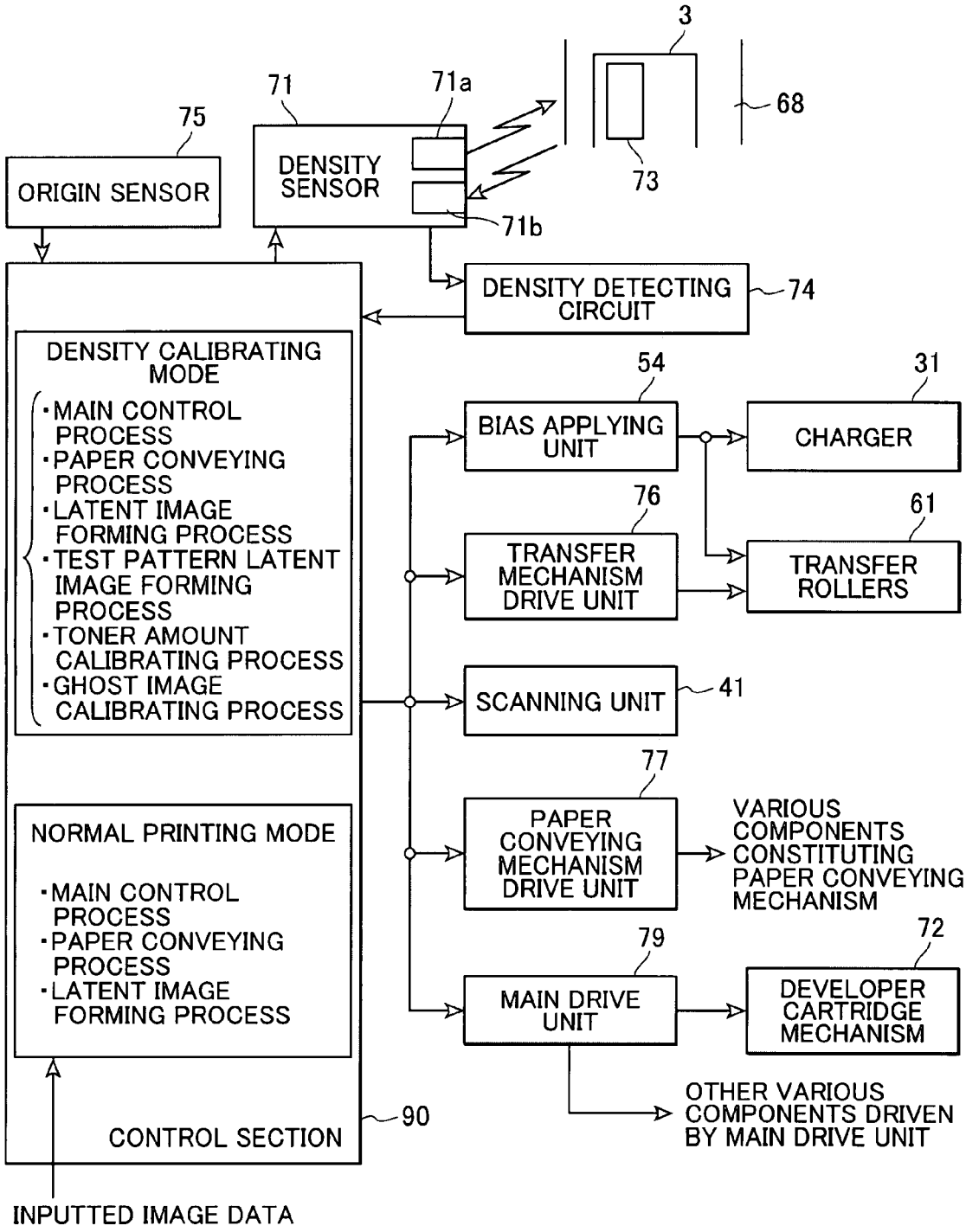
FIG. 2 is a block diagram showing the electrical configuration of the printer.

The density sensor 71 is an optical sensor for detecting the existence of toner. As shown in FIG. 2, the density sensor 71 has a light-emitting unit 71*a* for irradiating light onto the paper 3 and a light-receiving unit 71*b* for receiving the light reflected from the paper 3 to detect whether toner exits or not on the paper 3. The density sensor 71 does not contact the paper 3 and, therefore, can detect the existence of toner without damaging the paper 3.

In addition to measuring densities on the paper 3, the density sensor 71 also serves to detect positional deviations of respective toner images formed by the image-forming units 20 and to detect ghost images formed by the image-forming units 20.

The conveyer belt follow roller 64 is disposed farther forward than the photosensitive drum 62 of the yellow image-forming unit 20Y, which is the image-forming unit 20 disposed farthest upstream with respect to the conveying direction of the paper 3, and is above and forward of the feeding roller 83. The conveyer belt drive roller 63 is disposed farther rearward than the photosensitive drum 62 of the black image-forming unit 20K, which is the image-forming unit 20 disposed farthest downstream with respect to the conveying direction of the paper 3, and is disposed diagonally downward and forward of the fixing section 8. The conveying belt 68 is looped around the conveyer belt drive roller 63 and the conveyer belt follow roller 64 so that the outer surface of this loop opposes and contacts all the photosensitive drums 62 of the image-forming units 20.

The conveyer belt drive roller 63 drives the conveying belt 68 to move in a circular path counterclockwise, while the conveyer belt follow roller 64 moves freely with the movement of the conveying belt 68. At this time, the outer surface of the conveying belt 68 moves in the same direction as the surface of the photosensitive drums 62 at the contact points between the two.

The transfer rollers 61 are disposed on the inner side of the conveying belt 68 at positions corresponding to the photosensitive drums 62 of the image-forming units 20, interposing the conveying belt 68 between the transfer rollers 61 and photosensitive drums 62. Each transfer roller 61 includes a metal roller shaft covered by a roller part that is formed of a resilient member, such as a conductive rubber member.

The transfer rollers 61 are capable of rotating counterclockwise so that the surfaces of the transfer rollers 61 at the point of contact with the conveying belt 68 move in the same direction as the surface of the conveying belt 68. During a transfer operation, a voltage is applied to the transfer rollers 61 from a power source (not shown) through a constant current control, thereby generating a suitable transfer bias between the transfer rollers 61 and photosensitive drums 62 and causing the toner images carried on the photosensitive drums 62 to transfer onto the paper 3.

The fixing section 8 is disposed rearward and downstream of the image-forming units 20 and transfer section 17. The fixing section 8 includes a heating roller 81 and a pressure roller 82. The heating roller 81 is configured of a metal tube with a release layer formed on the surface thereof. The heating roller 81 accommodates a halogen lamp extending along the direction of its axis. The halogen lamp heats the surface of the heating roller 61 to a prescribed temperature. The pressure roller 82 contacts the heating roller 81 with pressure.

The paper discharge section 6 is provided on the top of the main casing 5 downstream of the fixing section B. The paper discharge section 6 includes a pair of discharge rollers 11 for discharging sheets of the paper 3 after the image has been fixed on the paper 3, and a discharge tray 10 for accumulating the sheets of paper 3 discharged by the discharge rollers 11.

Next, the electrical structure of the printer 1 will be described while referring to FIG. 2.

A description will also be given for the various processes that the printer 1 performs in a normal printing mode to form multicolor images on the paper 3 through cooperative operations of the printer's various components.

As shown in FIG. 2, the printer 1 includes the control section 90 that performs overall control of each component in the printer 1. The control section 90 has a built-in CPU 90*a* (FIG. 5), ROM, RAM, and the like (not shown). The control section 90 is configured to perform an image-forming operation in a normal print mode. The control section 90 is configured also to perform, in a toner density calibrating mode, an operation for calibrating toner amount and correcting deviation in color images, and to perform an operation for setting a transfer bias (transfer current).

The control section 90 is connected to: an origin sensor 75 for detecting a point of origin on the conveying belt 68; the density sensor 71; a density detecting circuit 74 for converting an analog signal from the density sensor 71 to digital data; a bias applying unit 54 for applying voltages to the transfer rollers 61 and the chargers 31; a transfer mechanism drive unit 76 for driving the transfer rollers 61; the scanning units 41; a paper conveying mechanism drive unit 77 for driving components in the printer 1 that convey the paper 3; and a main drive unit 79 for driving a developer cartridge mechanism 72.

The ROM in the control section 90 is prestored with a normal printing mode program. The normal printing mode program is configured from a main control process program, a latent image forming process program, and a paper conveying process program. By executing the respective process programs in the normal printing mode program in a predetermined order, the CPU 90*a* in the control section 90 executes necessary operations in the normal printing mode.

The ROM in the control section 90 is also prestored with a toner density calibrating mode program. The toner density calibrating mode program is configured from the main control process program, the latent image forming process program, the paper conveying process program, a test pattern latent image forming process program, a toner amount calibrating process program, and a ghost image calibrating process program. By executing the respective process programs in the toner density calibrating mode program in a predetermined order, the CPU 90*a* in the control section 90 executes necessary operations in the toner density calibrating mode.

Next will be described how the printer 1 operates in the normal printing mode.

When the control section 90 of the printer 1 receives image data inputted from an external source while in the normal print mode, the control section 90 drives the paper conveying mechanism drive unit 77 based on the paper conveying process program. The paper conveying mechanism drive unit 77 drives the feeding roller 83, developing roller 52, and conveying rollers 14*a* and 14*b* to begin feeding the topmost sheet of the paper 3 stacked on the paper tray 12.

Based on the main control process program, the control section 90 initializes settings for each component controlled during the image forming process, inputs control signals to the main drive unit 79 to drive the developer cartridge mechanism 72 with a motor provided in the main drive unit 79. When the developer cartridge mechanism 72 is driven, the supply roller 32 and photosensitive drum 62 rotate in a fixed direction. At this time, the control section 90 drives the transfer mechanism drive unit 76 to rotate the transfer rollers 61 in synchronization with the photosensitive drums 62. At the same time, the control section 90 operates the bias applying unit 54 so that the bias applying unit 54 applies a voltage to the transfer roller 61 through a constant current control and applies a prescribed charging voltage to the charger 31 to generate transfer bias between the transfer roller 61 and photosensitive drum 62. Thus, the charger 31 applies a uniform positive charge to the surface of the photosensitive drum 62 before an electrostatic latent image is formed thereon so that a transfer bias is applied between the transfer roller 61 and the photosensitive drum 62.

According to the latent image forming process program, the control section 90 drives the scanning unit 41 by inputting control signals into the scanning unit 41 based on the input image data. The control signals are inputted at a prescribed timing based on an origin position (mark) on the conveying belt 68 that has been detected by the origin sensor 75.

Specifically, through operations of the control section 90 described above, the printer 1 irradiates laser light from the scanning unit 41 onto the surface of the photosensitive drum 62 at a prescribed exposure point, after the photosensitive drum 62 has been charged with a positive polarity. This exposure changes the potential on the surface of the photosensitive drum 62 at this point from the potential directly after charging, thereby forming an electrostatic latent image on the surface of the photosensitive drum 62 based on the input image data. By rotating the photosensitive drum 62, the printer 1 conveys this latent image formed at the exposure point to the developing roller 52 positioned downstream of the exposure point with respect to the rotational direction of the photosensitive drum 62.

The latent image formed on the photosensitive drum 62 is put in contact with the developing roller 52. When the latent image on the photosensitive drum 62 contacts the developing roller 52, toner supplied from the developing roller 52 develops the image on the surface of the photosensitive drum 62 into a toner image.

After the toner image has been formed, the printer 1 conveys the toner image to a transfer point by rotating the photosensitive drum 62. The transfer point is a position downstream of a developing point at which the developing roller 52 has developed the toner image. At this position, the photosensitive drum 62 is in contact with the paper 3 on the transfer roller 61 via the conveying belt 68. The printer 1 transfers the toner image to the surface of the paper 3 at this transfer point (nip part between the photosensitive drum 62 and the paper 3 on the transfer roller 61).

The control section 90 performs the series of operations described above, from the step for forming an electrostatic latent image to the transfer step, for each color of toner. The toner image formed in each color is sequentially superimposed on the previous toner images as the conveying belt 68 progresses, resulting in a multicolor toner image being formed on the surface of the paper 3 as a composite of the toner images in each color.

Specifically, the control section 90 first uses the yellow image-forming unit 20Y to develop a yellow latent image with yellow toner, resulting in a yellow toner image. The yellow image-forming unit 20Y transfers the yellow toner image onto the surface of the paper 3 at the transfer point.

Subsequently, the control section 90 sequentially forms color images in magenta, cyan, and black in the same way and superimposes these images over the yellow image on the paper 3. According to the latent image forming process described above, the control section 90 controls the timing for driving each scanning unit 41 based on the rotational period of the conveying belt 68 and the distance separating each image-forming unit 20 in order to properly superimpose the toner images. At this timing, the control section 90 forms electrostatic latent images on each photosensitive drum 62 that are subsequently developed into toner images in each color. These toner images are transferred onto the paper 3 at the transfer point for each color. In this ways, a multicolor image is formed on the paper 3.

Next will be described how the printer 1 operates in the toner density calibrating mode. In the toner density calibrating mode, the control section 90 performs the operation for calibrating toner density and correcting deviation in color images, and the operation for setting a transfer bias (transfer current).

In the toner density calibration mode, the control section 90 first performs the operation for calibrating toner amount and correcting deviation in color images in a manner described below.

The control section 90 first executes the test pattern latent image forming process program by using data of a test pattern in place of image data of a desired image inputted in the normal print mode described above. The control section 90 forms a toner image of the test pattern on the paper 3 according to the same procedure in the normal print mode.

Next, by executing the toner amount calibrating process program, the control section 90 reads the density of the test pattern using the density sensor 71 shown in FIG. 1. More specifically, the density sensor 71 converts the density of the test pattern formed on the paper 3, or of the paper 3 itself, into voltages and outputs this data. The data outputted from the density sensor 71 is converted from analog to digital data by the density detecting circuit 74. This converted data is inputted into the control section 90.

The control section 90 determines whether the toner density of each color has been accurately reproduced based on the density of toner that has been supplied by the developer cartridges 51C, 51M, 51Y, and 51K and that has been detected by the density sensor 71. If it appears that the toner density of a color has not been reproduced accurately, the control section 90 calibrates the amount of toner deposited on the photosensitive drum 62. The control section 90 calibrates the amount of toner by controlling the developing bias (potential difference between the developing roller 52 and photosensitive drum 62), for example. At this time, the control section 90 also corrects positional deviations of toner images based on the detection results by the density sensor 71 by controlling the driving timings of the scanner units 41 relative to one another.

Figure 6:
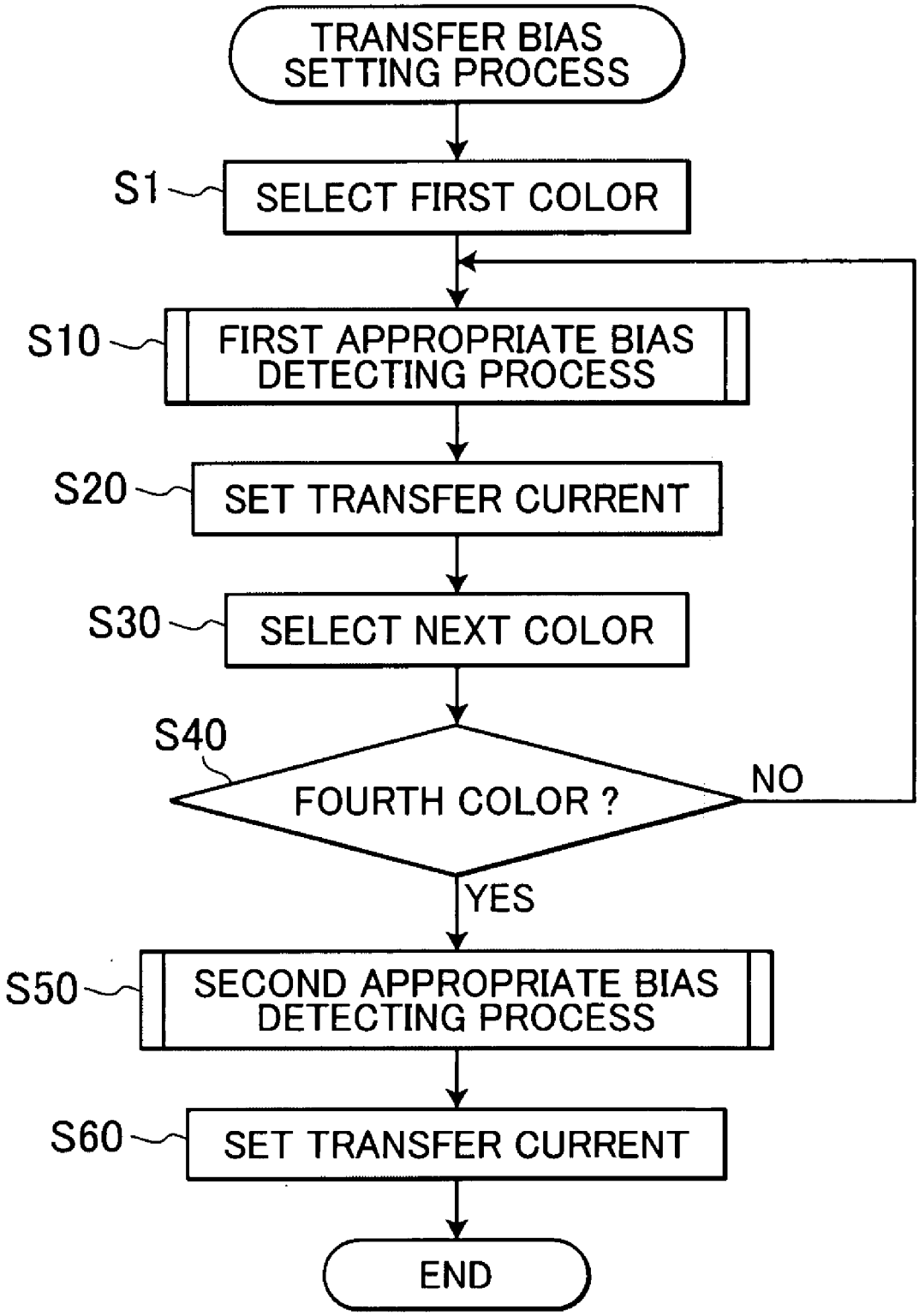
FIG. 6 is a flowchart illustrating steps in a transfer bias setting process according to the first embodiment.
Figure 7:
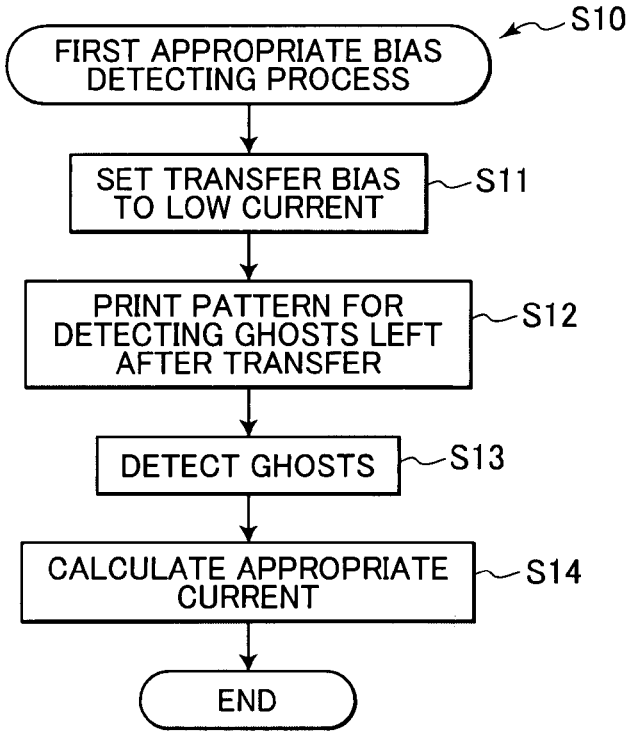
FIG. 7 is a flowchart illustrating steps in a first appropriate bias detecting process in the transfer bias setting process of FIG. 6.
Figure 9:
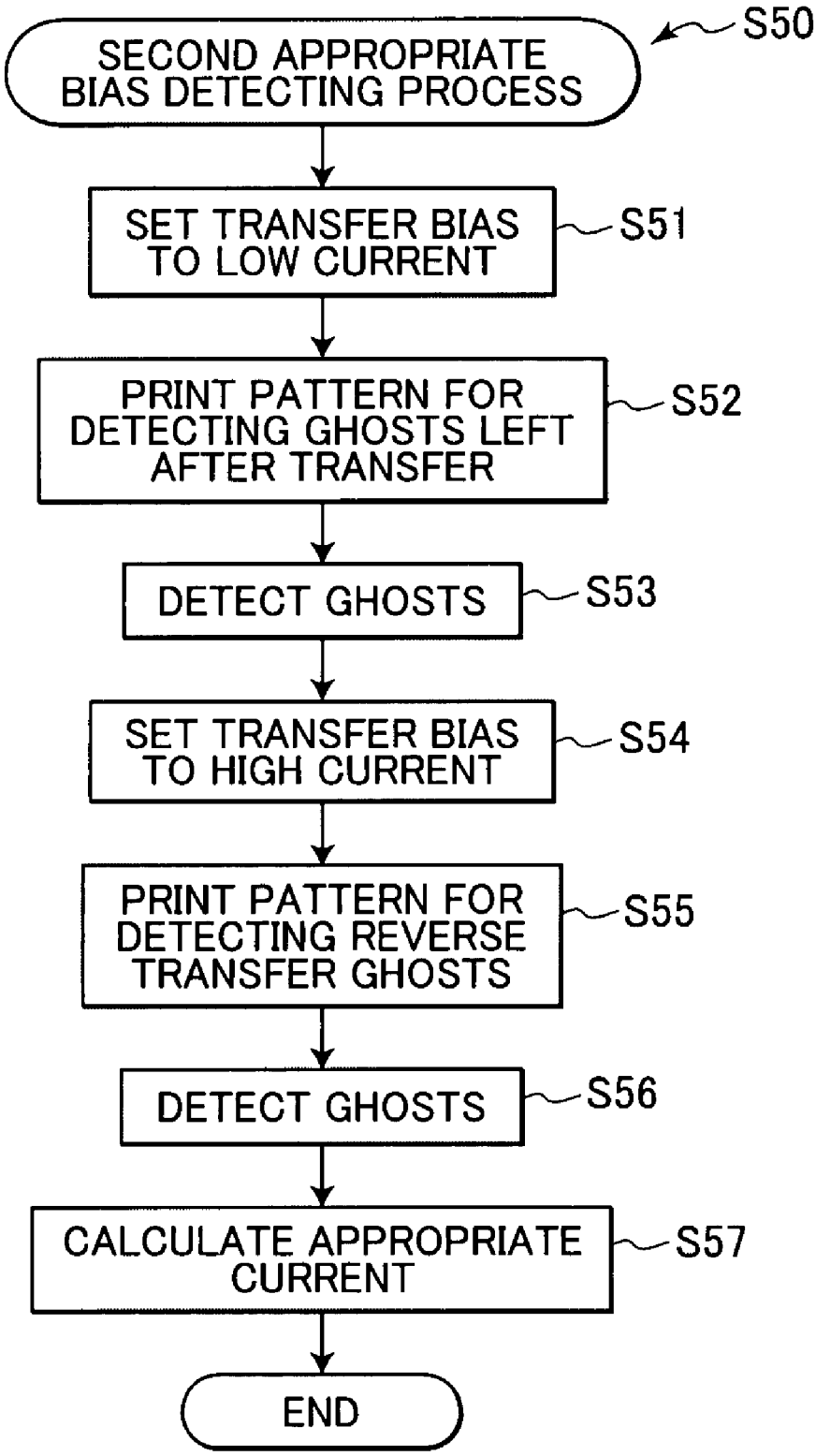
FIG. 9 is a flowchart illustrating steps in a second appropriate bias detecting process in the transfer bias setting process of FIG. 6.

In the toner density calibration mode, after calibrating toner amount and correcting deviation in color images as described above, the control section 90 performs the operation for setting a transfer bias (transfer current) as shown in FIGS. 6, 7, and 9 in a manner described below.

Next, the transfer bias setting process will be described briefly.

Figure 8:
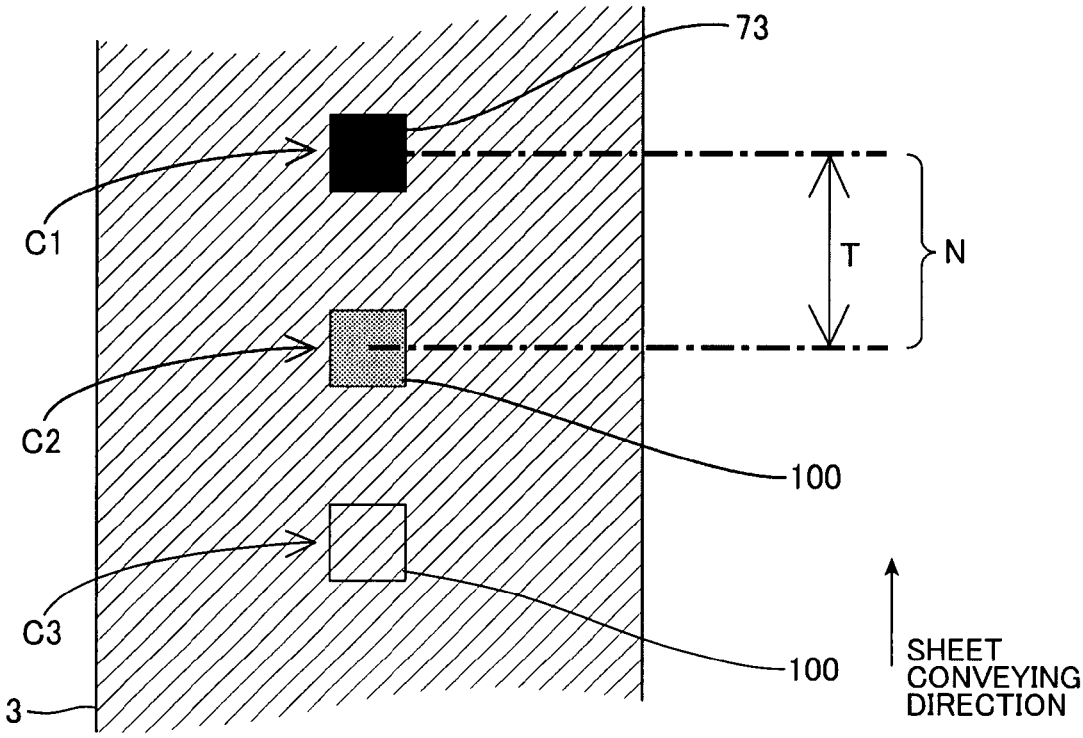

Similarly to the operation for calibrating toner amount and correcting deviation in color images, the control section 90 executes the test pattern latent image forming process program by using data of a test pattern 73. The control section 90 forms a toner image of the test-pattern 73 at a location C1 on the paper 3 as shown in FIG. 8 according to the same procedure in the normal print mode. In this example, the test pattern 73 is a square pattern as shown in FIG. 8.

It is noted that the test pattern used in the operation for calibrating toner amount and correcting deviation in color images may be the same as or different from the test pattern 73 used in the transfer bias setting process.

The control section 90 then controls the density sensor 71 to read the density of the paper 3 and to set a transfer bias (transfer current) according to the ghost image calibrating process program. It is noted that the density sensor 71 measures the density at a location C2 of the paper 3 that is located within a non-image-forming region N. The non-image-forming region N extends from the location C1 of the test pattern 73 by the length of at least one circumferential length T of the photosensitive drum 62 in a direction opposite to the conveying direction of the paper 3. Thus, the location C2 is positioned following the location C1 in the sheet conveying direction and is separated from the location C1 by a distance that is smaller than or equal to the entire length of the non-image-forming region N.

In this example, the location C2 is shifted from the location C1 by exactly the one circumferential length T of the photosensitive drum 62. As the photosensitive drum 62 rotates, the same, single portion of the photosensitive drum 62 first contacts the location C1 and next contacts the location C2. When the subject portion of the photosensitive drum 62 first contacts the location C1, the test pattern 73 is transferred from the photosensitive drum 62 to the location C1. Then, when the subject portion contacts the sheet 3 next, the subject portion contacts the location C2, and a ghost image of the test pattern 73 is transferred from the photosensitive drum 62 to the location C2.

While the photosensitive drum 62 rotates by at least one rotation after transferring the test pattern 73 onto the sheet 3, the control section 90 performs only a transfer operation by controlling the transfer roller 61 to transfer toner remaining on the photosensitive drum 62 onto the paper 3, while controlling the scanning unit 41 to form no electrostatic latent image on the photosensitive drum 62. In other words, while the photosensitive drum 62 is rotating by at least one rotation after having transferred the test pattern 73 onto the sheet 3, the control section 90 does not execute the test pattern latent image forming process program. Accordingly, the non-image-forming region N is formed on the paper 3.

The ghost image phenomenon will be described below in greater detail.

The image-forming section 4 employs a cleanerless method (simultaneous developing and cleaning method), in which no cleaning mechanism is provided for removing toner remaining on the surface of the photosensitive drum 62 after a transfer (toner left after transfer) and for removing toner transferred back to the photosensitive drum 62 from the paper 3 during a transfer (reverse transfer toner). Toner that is left on the photosensitive drum 62 after a toner image has been transferred onto the paper 3 at the transfer section 17 is recovered by the developer cartridge 51 and reused for image development.

Because the image-forming section 4 employs a cleanerless method, a toner image will possibly be formed at unintended positions on a sheet 3. A toner image that is formed at a position on a sheet 3 for which no image has been intended to be formed is commonly referred to as a "ghost" (a "ghost left after transfer" if the cause is toner left after transfer or a "reverse transfer ghost" if the cause is reverse transfer toner) or a "ghost image."

The ghost left after transfer phenomenon occurs when toner is not collected on the developing roller 52 and is transferred onto the paper 3.

Figures 3A, 3B, 3C, 3D:
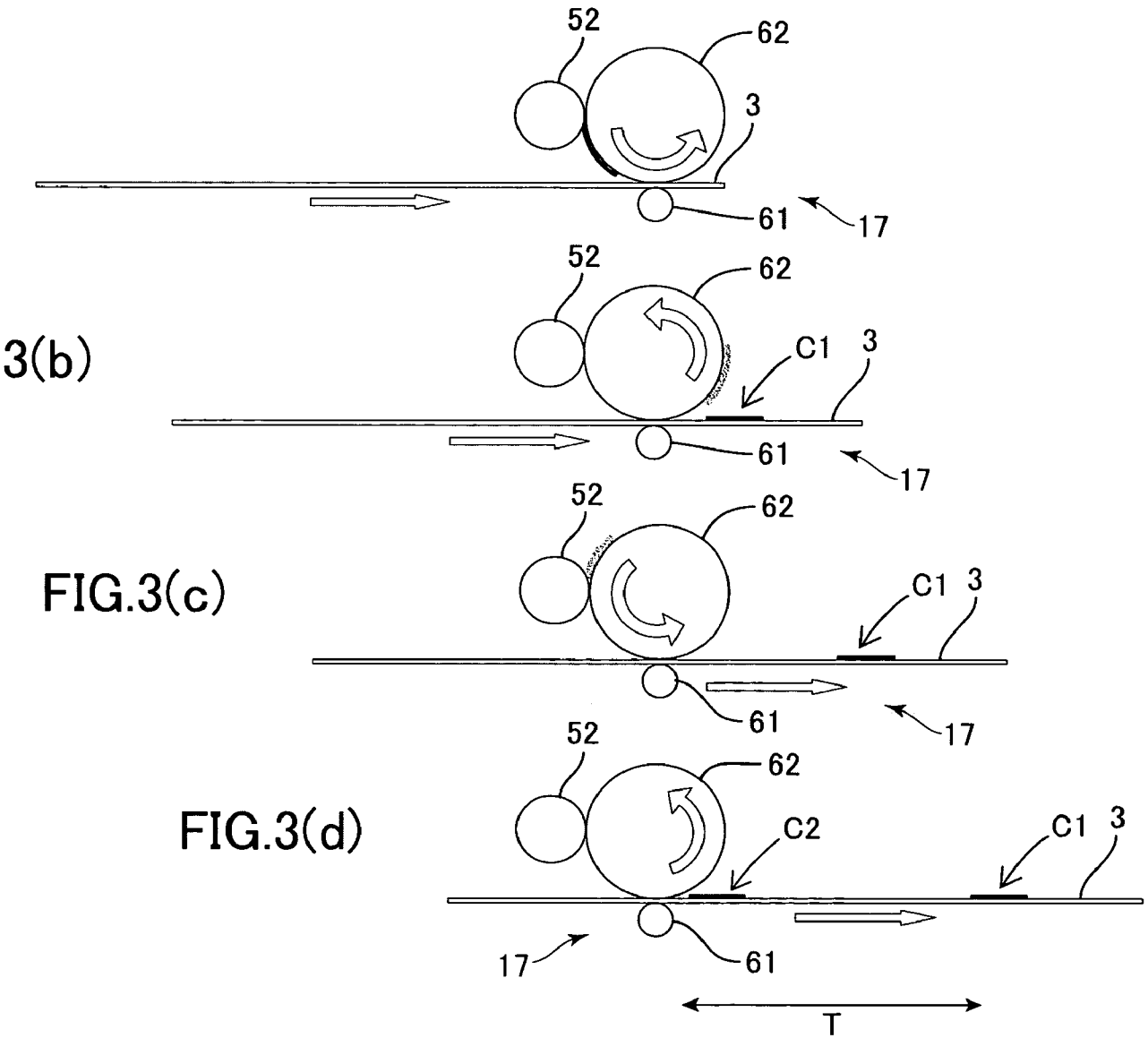
FIGS. 3(*a*)-3(*d*) are explanatory diagrams illustrating the generation of a ghost left after transfer.
Figure 4A:
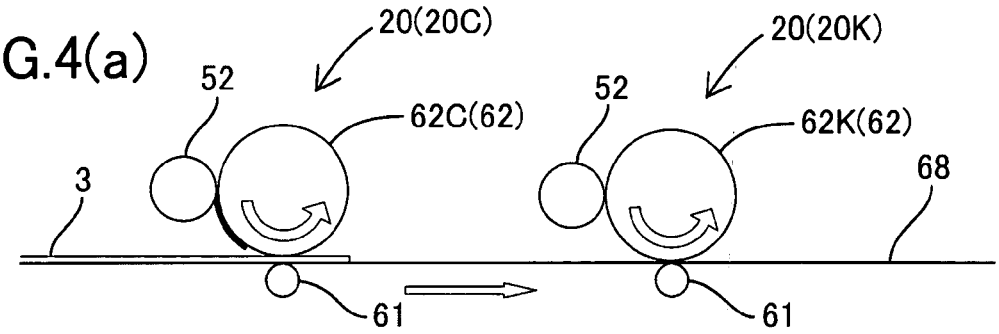
FIGS. 4(*a*)-4(*e*) are explanatory diagrams illustrating the generation of a reverse transfer ghost.
Figure 4B:
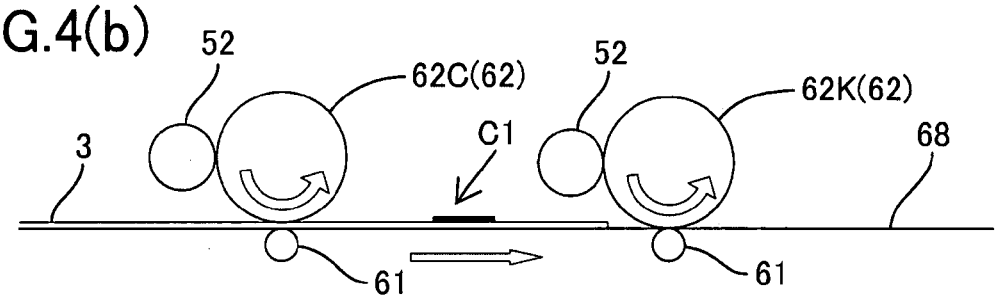
Figure 4C:
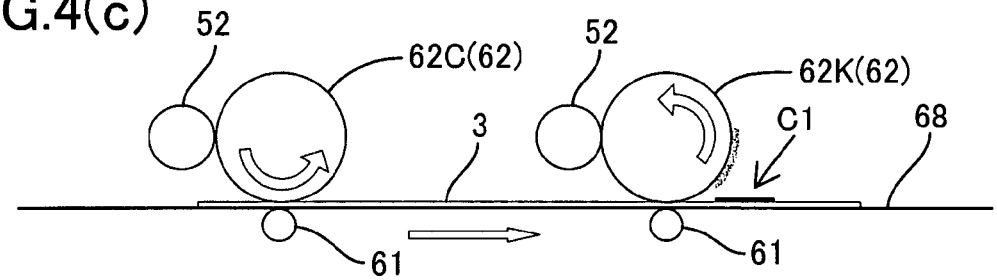
Figure 4D:
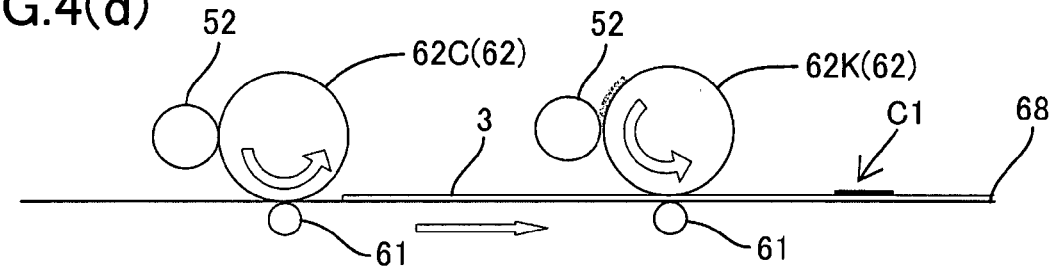
Figure 4E:
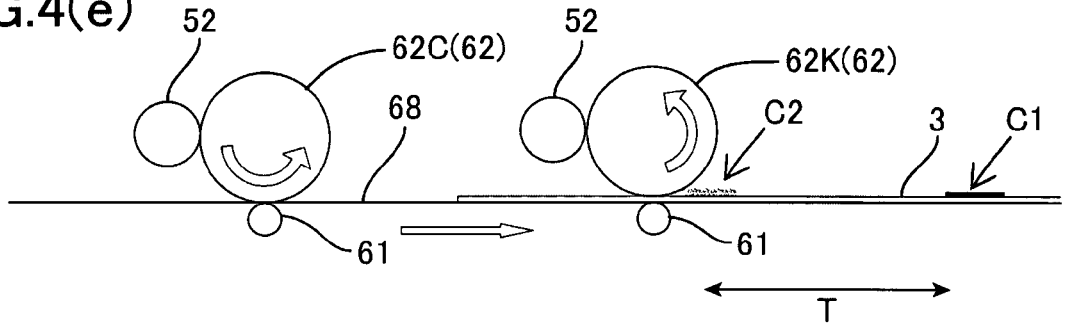

FIGS. 3(*a*) and 3(*b*) illustrate a case when toner is not completely transferred onto the paper 3 in the transfer section 17 (see FIG. 1) but remains deposited on the photosensitive drum 62 as toner left after transfer (note that the conveying direction in FIGS. 3(*a*)-3(*d*) is opposite that in FIG. 1). In other words, a part of toner on the photosensitive drum 62 is transferred onto the paper 3 at its location C1, while a remaining toner remains deposited on the photosensitive drum 62.

As the photosensitive drum 62 continues to rotate, as shown in FIG. 3(*c*), the surface of the photosensitive drum 62 is recharged at a charging position opposing the charger 31. The toner that is deposited in areas not exposed by the scanning unit 41 maintains a charge potential and is therefore attracted to and collected by the developing roller 52 when the toner comes into contact with the developing roller 52, because the potential of the developing roller 52 is lower than that of the photosensitive drum 62. However, some of the toner remains on the surface of the photosensitive drum 62 and is not collected by the developing roller 52. At this time, the toner not collected by the developing roller 52 is transferred onto the paper 3 as shown in FIG. 3(*d*). The toner is transferred to the location C2 on the paper 3. The location C2 is on the upstream side of the location C1 in the sheet conveying direction and is separated from the location C1 by a distance equal to the circumferential length T of the photosensitive drum 62. The location C2 is a region where no images have been intended to be formed.

The toner is less likely to be completely transferred as the transfer bias between the photosensitive drum 62 and the transfer roller 61 decreases, tending to generate more toner left after transfer.

Reverse transfer toner is generated on the paper 3 when a visible image is transferred onto the paper 3 at one of the image-forming units 20 for the second or further downstream colors magenta, cyan, and black. The reverse transfer toner is toner that has been previously transferred onto the paper 3 by one of the developer cartridges 51 upstream from the current image-forming unit 20 and is then transferred back onto the photosensitive drum 62 of the current image-forming unit 20.

Next, the occurrence of reverse transfer ghosts will be described for the cyan and black image-forming units 20*c* and 20K with reference to the example in FIGS. 4(*a*)-4(*e*) (note that the conveying direction in FIGS. 4(*a*)-4(*e*) is opposite that in FIG. 1).

FIGS. 4(*a*) and 4(*b*) show toner transferred onto the paper 3 at a location C1 by the cyan image-forming unit 20C disposed upstream of the black image-forming unit 20K. A portion of this toner is transferred onto the black photosensitive drum 62K of the black image-forming unit 20K that is located downstream from the cyan image-forming unit 20C, as shown in FIG. 4(*c*). As illustrated in FIGS. 4(*d*) and 4(*e*), the toner is redeposited to a location C2 on the paper 3. The location C2 is located upstream from the location C1 in the sheet convening direction and is shifted from the location C1 by the length of one circumferential length T of the black photosensitive drum 62K.

It is considered that this phenomenon occurs when toner transferred temporarily onto the paper 3 becomes charged at the polarity opposite the original polarity. Although the mechanism of this generation is not clearly understood, reverse transfer toner is generated more frequently as the transfer bias increases. The amount of reverse transfer toner increases as the charge amount of the toner already transferred to the paper 3 increases. It is noted that the charge amount of the toner already transferred to the paper 3 at the upstream-side image-forming unit 20 increases as the transfer bias applied in the upstream-side image-forming unit 20 increases.

It is noted that potentials of amounts needed to transfer toner to the paper 3 are applied to the developing roller 52, photosensitive drum 62, and transfer roller 61. In this example, the charger 31 charges the surface of the photosensitive drum 62 to +700 V. A developing bias of +550 V is applied to the developing roller 52. When the scanning unit 41 irradiates a laser beam on the surface of the photosensitive drum 62, the potential of portions of this surface exposed to the laser beam drops to about +200 V. A potential is applied to the developing roller 52 through a constant voltage control in order to generate a developing bias between the developing roller 52 and the photosensitive drum 62.

Rather than a constant voltage control, a constant, current control is used for the transfer roller 61 in order to supply a uniform current to the transfer roller 61. Constant voltage control is not used for the transfer bias applied to the transfer-roller 61 because the thickness of the paper 3 interposed between the transfer roller 61 and photosensitive drum 62 to receive a toner image from the photosensitive drum 62 will possibly be non-uniform. A different thickness of paper 3 will result in a different current flowing from the photosensitive drum 62 to the transfer roller 61, thereby changing the quality of the toner image being transferred. Changes due to the environment or wear will also possibly change the resistance of the transfer roller 61, conveying belt 68, and the like, which changes can bring about changes in transfer performance.

In order to prevent changes in quality of the transferred toner image due to changes in the thickness of the paper 3, the control section 90 controls the transfer bias applied to the transfer roller 61 via the bias applying unit 54 through a constant current control. The bias applying unit 54 has a power supply circuit (not shown) therein. The bias applying unit 54 can change the electric current value in steps (for example, five steps varied by units of 1 μA) in order to control the transfer bias.

It is noted that the bias applying unit 54 can set transfer bias for the transfer rollers 61 independently for the plurality of image-forming units 20. Accordingly, the bias applying unit 54 can optimize the transfer bias level for each image-forming unit 20.

Next, a process for setting a transfer current value will be described with reference to FIGS. 5 through 11.

Ghosts left after transfer occur when part of a toner image formed on the photosensitive drum 62 is not transferred onto the paper 3, but remains on the photosensitive drum 62 after the transfer operation. This toner remaining on the photosensitive drum 62 is normally referred to as "toner left after transfer." Toner left after transfer is generated more often when a weak transfer bias is applied to the transfer section. This toner left after transfer often leads to ghosts left after transfer. However, when the transfer bias is so strong as to exceed an appropriate range, toner having a charge opposite the original polarity (reverse charge toner) is generated, causing an increase in the amount of toner left after transfer.

Reverse transfer ghosts, on the other hand, occur when toner is transferred back onto the photosensitive drum 62 during a subsequent transfer operation (reverse transfer toner). Reverse transfer toner is generated more frequently when the toner image already transferred onto the paper 3 has a higher potential (higher charge amount) or when a stronger transfer bias is applied to the transfer section, regardless of whether the original charge polarity of the toner is positive or negative. This reverse transfer toner tends to lead to reverse transfer ghosts.

Regardless of whether the transfer bias is applied by the constant current control method or constant voltage control method, the transfer bias applied to the transfer section 17 has to be greater than or equal to a lower limit at which ghosts left after transfer are not generated (or are not visible enough to be a problem). Moreover, the transfer bias has to be less than or equal to an upper limit at which ghosts left after transfer and reverse transfer ghosts are not generated (or are not visible enough to be a problem).

The transfer bias setting process of the present embodiment finds an appropriate value for the transfer bias that satisfactorily falls in this range.

Figure 5:
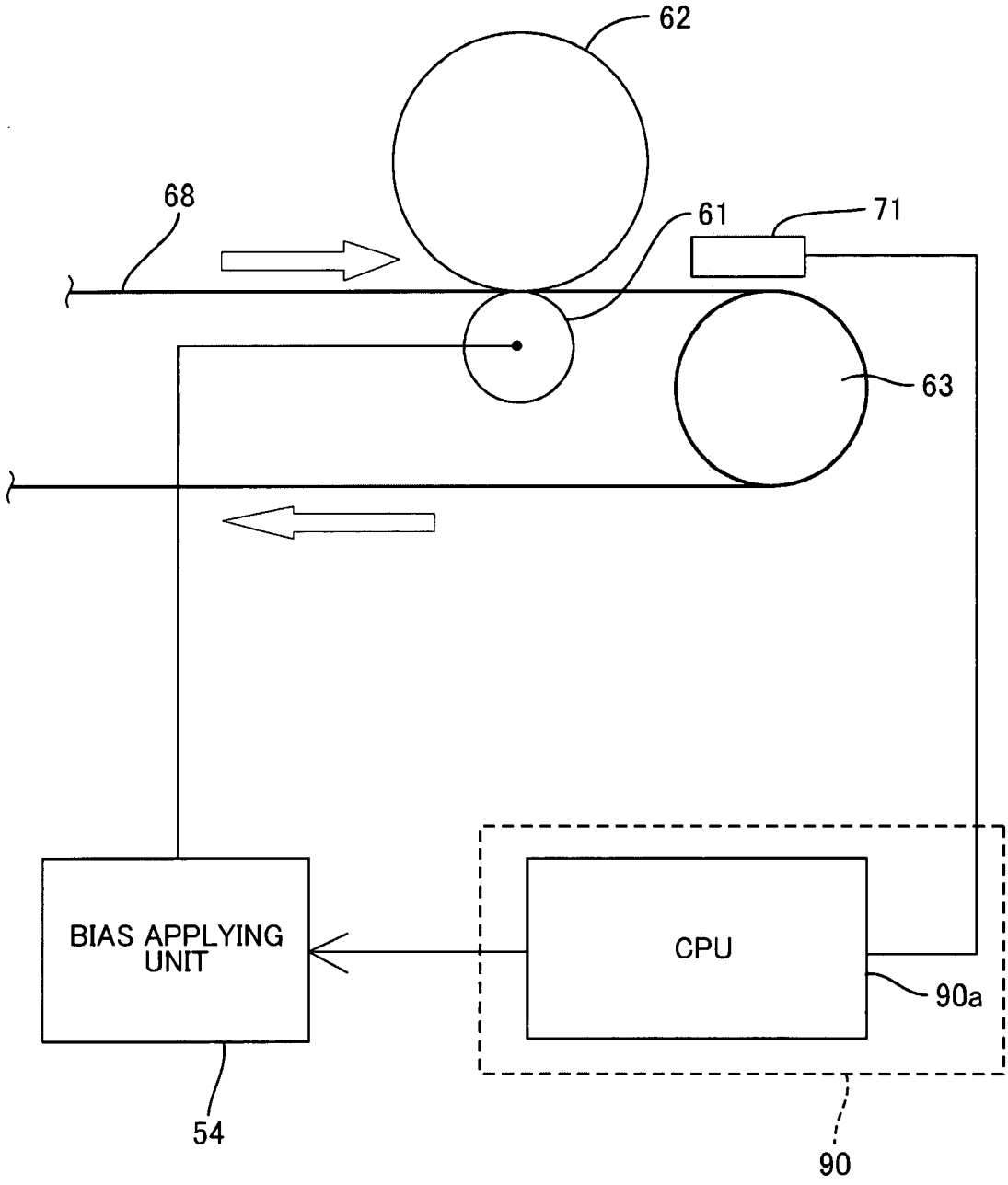
FIG. 5 is an explanatory diagram showing the relationships among a density sensor, a control section, a bias applying unit, and a transfer roller.

FIG. 5 shows a conceptual view of the relevant construction of the printer 1 for finding an appropriate value of the transfer bias.

In the preferred embodiment, the density sensor 71 reads the density of a ghost image of the test pattern 73 formed on the paper 3. The CPU 90*a* of the control section 90 performs calculations based on the density level detected by the density sensor 71 and outputs control signals to the bias applying unit 54 based on this calculation. In this way, the control section 90 controls the level of the transfer bias applied to the transfer roller 61.

FIG. 6 is a flowchart illustrating steps in the transfer bias setting process that the control section 90 performs according to the test pattern latent image forming process program and the ghost image calibrating process program. FIG. 7 is a flowchart illustrating steps in a first appropriate bias detecting process of S10 in the transfer bias setting process of FIG. 6. FIG. 8 is an explanatory diagram showing the detecting position for ghosts. FIG. 9 is a flowchart illustrating steps in a second appropriate bias detecting process of S50 in the transfer bias setting process of FIG. 6.

At the beginning of the transfer bias setting process in S1 of FIG. 6, the control section 90 selects the first color (yellow color, in this example).

In S10 the control section 90 executes the first appropriate bias detecting process, for the selected color.

In the first appropriate bias detecting process of FIG. 7, the control section 90 sets the transfer bias between the transfer roller 61 and photosensitive drum 62 to a predetermined first ghost generation level, at which ghosts left after transfer are generated, thereby generating ghosts that are caused when part of toner images formed in an image-forming region are deposited in a non-image-forming region of the paper.

Figure 10A:
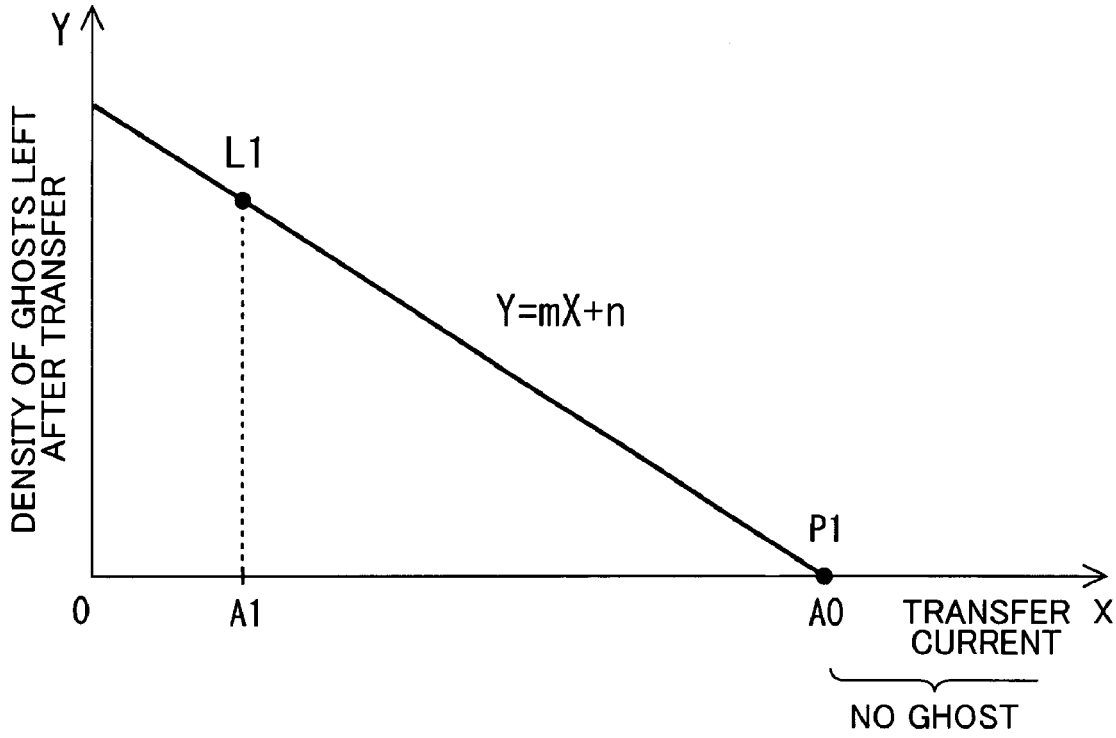
FIG. 10(*a*) is a graph illustrating an example of the relationship between the transfer current and the density of ghosts left after transfer.
Figure 10B:
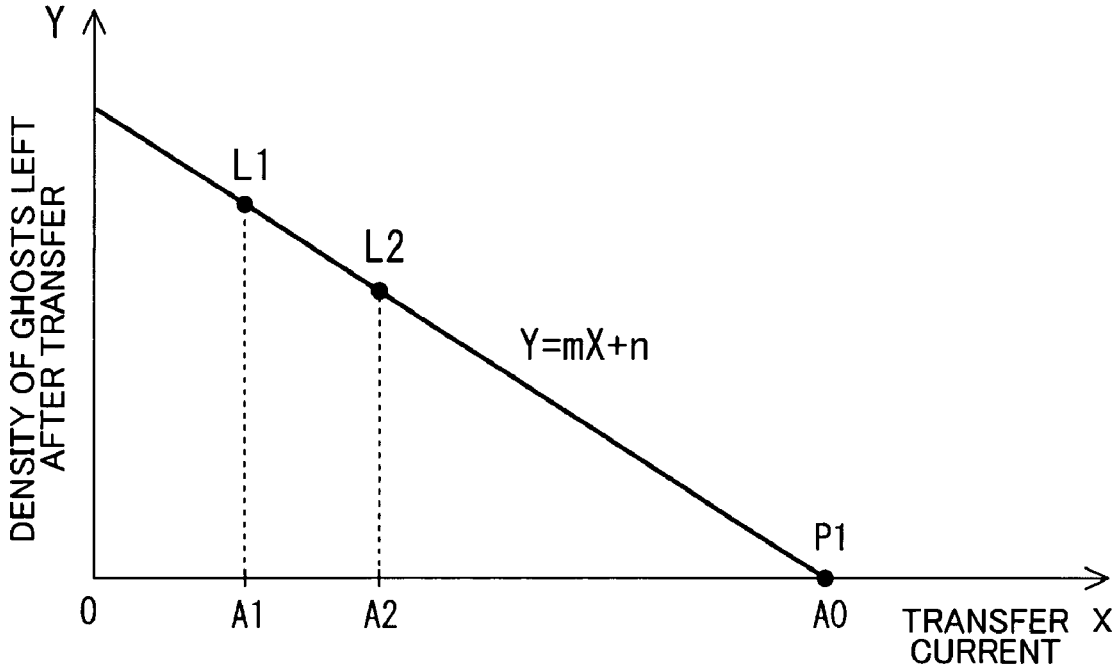

More specifically, in S11 of FIG. 7, the control section 90 sets the transfer bias, to be applied to the transfer roller 61 of the first color (yellow color), to a predetermined first ghost-generating low level (transfer current amount) A1 (FIG. 10(*a*)), which is capable of reliably producing ghosts left after transfer and which is a device-specific value unique to the printer 1.

In S12 the control section 90 forms a toner image of a test pattern 73 on a paper 3 by applying the transfer bias of the first ghost generation level A1 to the transfer roller 61 for the image-forming unit 20 (20Y) of the first color and by controlling the image-forming unit 20 (20Y) of the first color to perform an image-forming operation. The toner image of the test pattern 73 is transferred at a location C1 on the paper 3 as shown in FIG. 8.

It is noted that the control section 90 forms on the paper 3 a non-image-forming region N, which extends from the location C1 of the test pattern 73 by the length of at least one circumferential length T of the photosensitive drum 62 in the conveying direction of the paper 3, by performing only a transfer operation by controlling the transfer roller 61 to transfer a toner image from the photosensitive drum 62 in the image-forming unit 20 (20Y) for the first color onto the paper 3, without controlling the scanning unit 41 in the image-forming unit 20 (20Y) for the first color to irradiate any laser beam onto the photosensitive drum 62.

As shown in FIG. 8, a ghost-left-after-transfer-image 100 is formed at a plurality of locations C2, C3, . . . , which are located upstream of the location C1, at which the test pattern 73 is formed, in the conveying direction of the paper 3, and which are separated from the location C1 by lengths 1xT, 2xT, . . . that are equal to integral multiples of the circumferential length T of the photosensitive drum 62. It can be considered that the ghost-left-after-transfer image 100 formed at the region C2, which is separated from the location C1 by exactly one circumferential length T of the photosensitive drum 62, has the highest density among the ghost-left-after-transfer images 100 at the locations C2, C3, . . . . Accordingly, in the transfer bias setting process of the present embodiment, as described below, the control section 90 controls the density sensor 71 to measure the density of the ghost-left-after-transfer image 100 at this region C2, and sets the measured density level as a density L1 (FIG. 10(*a*)) of the generated ghost image 100.

In S13 the density sensor 71 detects the density level of the ghost image deposited in the location C2, and sets the detected density level as the density L1 (FIG. 10(*a*)) of this ghost image.

In S14 the control section 90 determines a transfer bias level A0 (FIG. 10(*a*)) based on the predetermined first ghost generation level A1 (FIG. 10(*a*)) and the ghost density level L1 (FIG. 10(*a*)), and sets the determined transfer bias level A0 as a transfer bias level for the transfer roller 61 appropriate for forming images at the image-forming unit 20 (20Y) of the first color.

In this way, according to the preferred embodiment, only one ghost generation level A1 is set for the image-forming unit 20Y. The density sensor 71 detects the density level L1 of ghosts generated with the test pattern 73-formed at this first ghost generation level A1. The control section 90 then sets the transfer bias level A0 appropriate for forming images based on this first ghost generation level A1 and the density level L1 of ghosts formed from the test pattern 73 at the first ghost generation level A1.

More specifically, in S14 the CPU 90*a* calculates a transfer bias level (transfer current amount) A0 appropriate for forming images using a predetermined equation having the parameters of the first ghost generation level A1 and the density level L1 of ghosts corresponding to the first ghost generation level A1.

As shown in FIG. 10(*a*), the transfer bias is calculated by estimating a range of a transfer bias levels, in which ghosts left after transfer will not be generated, based on the first level A1 at which ghosts left after transfer are generated and a density level. L1 of ghosts produced when forming the test pattern 73 at the first level A1. The transfer bias level appropriate for forming images with the transfer roller 61 of the current color is set to the minimum value A0 in the range of transfer bias levels at which ghosts left after transfer will not be generated.

More specifically, the range in which ghosts will not be generated is estimated according to the equation $Y=mX+n$, where the variable Y is the density level of the ghost left after transfer and the variable X is the transfer bias level (level of the transfer current). The equation $Y=mX+n$ is used to find a point P1 at which the density of the ghost left after transfer is zero based on the first level A1 when a ghost left after transfer is generated and the density level L1 of the ghost formed at the first level A1. The range of transfer bias levels at which a ghost will not be generated is the range of transfer bias levels greater than the level A0 at the point P1. In the example of FIG. 10(*a*), the value of m is preset as a device-specific value unique to the printer 1. Since the value of the variable n can be determined by finding the relationship between the density level L1 of the ghost left after transfer and the transfer bias level A1 at a single point, it is possible to find the transfer bias level A0 at the given point P1 when the density of the ghost becomes zero. The transfer bias level appropriate for image formation is then set to the minimum value in the range at which ghosts will not be generated (in other words, the transfer bias level A0 at P1).

Returning to FIG. 6, once the transfer bias level appropriate for the first color is set in S20, the control section 90 selects the next color (second color (magenta color, in this example)) in S30.

In S40 the control section 90 determines whether the fourth color has been selected in S30 and repeats the processes from S10 to S40 until the fourth color (black color, in this example) has been selected. In this loop, the transfer bias level for the second and third colors (magenta and cyan, in this example) are calculated and set as described above for the first color.

If the transfer bias level were set too high in the image-forming unit 20Y, a toner image formed by the image-forming unit 20Y will more likely cause reverse ghost phenomenon to be generated in the image-forming units 20M, 20C, and 20K that are located downstream from the image-forming unit 20Y. Similarly, if the transfer bias level were set too high in the image-forming unit 20M, a toner image formed by the image-forming unit 20M will more likely cause reverse ghost phenomenon to be generated in the image-forming units 20C and 20K that are located downstream from the image-forming unit 20M. Similarly, if the transfer bias level were set too high in the image-forming unit 20C, a toner image formed by the image-forming unit 20C will more likely cause reverse ghost phenomenon to be generated in the image-forming unit 20K that is located downstream from the image-forming unit 20C. However, according to the present embodiment, the transfer bias level for each of the image-forming units 20Y, 20M, and 20C is set to the minimum of the range where no ghosts will be formed through the processes of S10-S30, this reduces not only the occurrence of the ghost left after transfer phenomena in the upstream image-forming units 20Y, 20M, and 20C while reducing the occurrence of reverse ghost phenomena in the downstream image-forming units 20M, 20C, and 20K.

When the fourth color has been selected (S40: YES), then the control section 90 performs a second appropriate bias detecting process in S50.

In the second appropriate bias detecting process, the control section 90 detects and sets an appropriate bias for the black image-forming unit 20K positioned farthest downstream. The transfer bias level applied between the transfer roller 61 and photosensitive drum 62 in the black image-forming unit 20K can be set to both of the predetermined first level A1 (FIG. 11(*a*)) for generating ghosts left after transfer and a predetermined second level B1 (FIG. 11(*a*)) for generating reverse transfer ghosts.

As shown in FIG. 9, in S51 the control section 90 sets the transfer bias level to the first level A1 for generating ghosts left after transfer in the same manner as in S11 in FIG. 7.

In S52 the control section 90 forms a test pattern (first test pattern) 73 corresponding to the first level A1 at location C1 on a paper 3 as shown in FIG. 8 in the same manner as in S12 in FIG. 7.

Figure 11A:
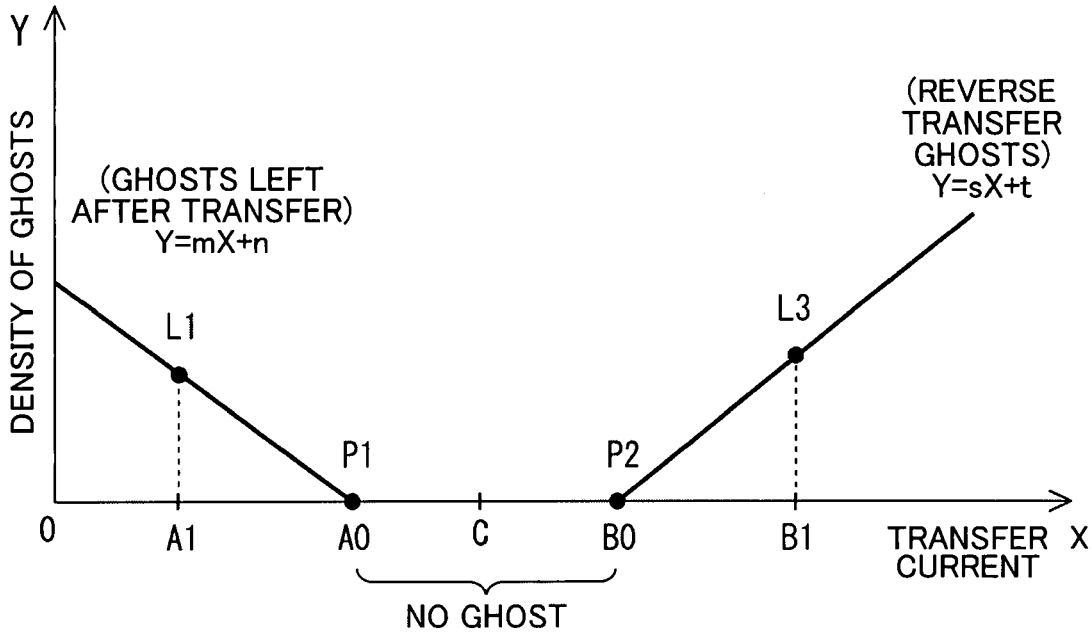
FIG. 11(*a*) is a graph illustrating an example of the relationship between the transfer current and the density of transfer ghosts.
Figure 11B:
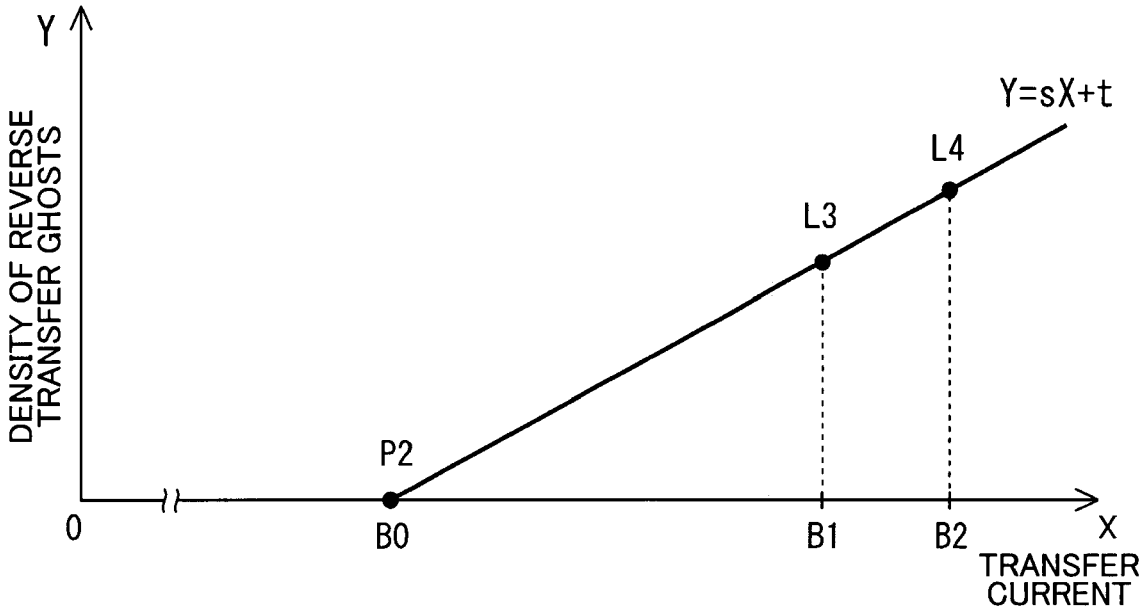

In S53 the density sensor 71 is controlled by the control section. 90 to detect the density level L1 (FIG. 11(*a*)) of a toner image deposited at the location C2, which is separated from the location C1 by the circumferential length T of the photosensitive drum 62, in the same manner as in S13 in FIG. 7.

In S54 the control section 90 sets the transfer bias to the second level B1 for generating reverse transfer ghosts. The second level B1 is a predetermined high current that can occur a reverse transfer ghost and that is a device-specific level unique to the printer 1.

In S55 the control section 90 forms another test pattern (second test pattern) 73 based on the second level B1 on a paper 3 at location C1 as shown in FIG. 8.

In S56 the density sensor 71 detects the density level L3 (FIG. 11(*a*)) of a toner image deposited at the location C2 that is separated from the location C1 by the circumferential length T upstream in the sheet conveying direction.

In S57 the CPU 90*a* of the control section 90 calculates a transfer current appropriate for the black image-forming unit 20K based on the detected levels.

More specifically, as shown in FIG. 11(*a*), the CPU 90*a* estimates a lower limit A0 of the transfer bias range, in which the ghost left after transfer phenomenon will not occur, based on the first level A1 and the density level L1, and estimates an upper limit B0 of the transfer bias range, in which the reverse ghost phenomenon will not occur, based on the second level E1 and the density level L3.

Next, the control section 90 sets, based on the calculated upper limit B0 and lower limit A0, an appropriate transfer bias level for forming images with the black image-forming unit 20K. That is, the control section 90 sets the appropriate transfer bias level to an intermediate value C between the upper limit B0 and lower limit A0 such that C=(A0+B0)/2. Accordingly, it is possible to maintain an appropriate margin for which both of the ghost left after transfer and the reverse transfer ghost do not occur.

It is noted that the lower limit A0 is estimated in the same way for the other image-forming units 20Y, 20M, and 20C (see FIG. 10(*a*)).

The upper limit 50 is estimated using another equation Y=sX+t that is different from that used to calculate the lower limit A0.

More specifically, the range in which ghosts will not be generated can be estimated according to the equation Y=sX+t, where the variable Y is the level of density for reverse transfer ghosts and the variable X is the transfer bias level (transfer current level). The control section 90 then finds a point P2 at which the density of the reverse transfer ghost reaches zero according to the equation Y=sX+t based on the second level B1 when reverse transfer ghosts are generated and the second density level L3 obtained at the second level B1. Hence, the range of transfer bias levels, in which ghosts will not be generated, is set to a range in which the transfer bias level is smaller than the bias level B0 at P2. In the example of FIG. 11(*a*), the value for s is a preset device-specific value unique to the printer 1. Since the value of the unknown t can be found for a single point by learning the relationship between the density level L3 of a reverse transfer ghost and the transfer bias level B1, it is possible to find the transfer bias level B0 at the estimated point P2 in which the density of the reverse transfer ghost reaches zero.

It is noted that while one image-forming unit 20 (20Y, 20M, or 20C) is forming a test pattern 73 in S12, transfer rollers 61 in other remaining image-forming units 20 are applied with no transfer biases, and perform no image-forming operations by not controlling their own scanning units 41. Similarly, while the black image-forming unit 20K is forming a test pattern 73 in S52, transfer rollers 61 in all the upstream image-forming units 20Y, 20M, and 20C are applied with no transfer biases, and perform no image-forming operations. On the other hand, while the black image-forming unit 20K is forming a test pattern 73 in S55, transfer rollers 61 in all the upstream image-forming units 20Y, 20M, and 20C are applied with the transfer biases of the values already set in S10 as appropriate for themselves. In other words, in S55, all the image-forming units 20Y, 20M, 20C, and 20K print test patterns 73 on the sheet 3 at the same, single location to form a test pattern 73 of a composite color of yellow, magenta, cyan, and black.

As described above; the first appropriate bias detecting process of S10 is executed for all image-forming units 20Y, 20M, and 20C excluding the image-forming unit 20K farthest downstream, while the second appropriate bias detecting process of S50 is executed for the image-forming unit 20K. Accordingly, the transfer bias level applied between the transfer roller 61 and photosensitive drum 62 for all image-forming units 20Y, 20M, and 20C is set to the first level A1 at which ghosts left after transfer occur. Because the reverse transfer ghost is less likely to occur in the upstream side image-forming units 20Y, 20M, and 20C, appropriate transfer bias can be determined for the image-forming units 20Y, 20M, and 20C by setting only the first level A1. Since the transfer biases are not set to the second level B1, at which reverse transfer ghosts occur, in the image-forming units 20Y, 20M, and 20C, the test pattern is not formed at the second level B1 for the image-forming units 20Y, 20M, and 20C on the upstream side. Accordingly, the printer 1 effectively reduces processing time by not forming the second test pattern for the image-forming units 20Y, 20M, and 20C other than the image-forming unit 20K farthest downstream. Because both of the ghost left after transfer and the reverse transfer ghost are likely to occur in the image-forming unit 20K, appropriate transfer bias can be determined for the image-forming unit 20K by setting both the first level A1 and the second level B1.

It is noted that the process of S10 may be executed at at least one of the image-forming units 20Y, 20M, and 20C other than the image-forming unit 20K farthest downstream, and the process of S50 may be executed at other remaining image-forming units 20 including the image-forming unit 20K. Or, the process of S50 may be executed at at least one of the image-forming units 20M, 20C, and 20K other than the image-forming unit 20Y farthest upstream, and the process of S10 may be executed at other remaining image-forming units 20 including the image-forming unit 20Y.

In the preferred embodiment described above, only one ghost generation level is set for each formulas Y=mX+n and Y=sX+t. However, the control section 90 may instead set a plurality of ghost generation levels for each formula. In this case, the control section 90 forms a test pattern for each of the plurality of ghost generation levels and sets a transfer bias level for forming images on the image-forming unit 20 based on the plurality of ghost generation levels and the plurality of density levels for ghosts formed by the plurality of ghost generation levels.

As shown in FIG. 10(*b*), the control section 90 can set a range in which ghosts will not occur using the equation Y=mX+n, where the variable Y is the density of a ghost left after transfer and the variable X is the transfer bias level. In this case, there are two unknowns m and n. The values for m and n can be identified by learning the relationships between two sets of density levels for ghosts left after transfer and the transfer bias levels using this equation, thereby identifying an estimated point P1 at which the density of the ghost left after transfer reaches zero. Hence, the control section 90 forms test patterns corresponding to two ghost generation levels A1 and A2, estimates a transfer bias level A0 at which the density of ghosts left after transfer reaches zero based on the ghost generation levels A1 and A2 and ghost density levels L1 and L2 for ghosts formed by these test patterns, and sets the transfer bias level for forming images in the image-forming unit 20 to this estimated level A0.

As with ghosts left after transfer, reverse transfer ghosts may also be considered in the same way. In other words, the control section 90 may set a plurality of ghost generation levels, form test patterns corresponding to each level, and set the transfer bias levels for forming images with the image-forming unit 20 based on the plurality of ghost generation levels and the density levels of ghosts formed from each test pattern.

As shown in FIG. 11(*b*), the control section 90 can set a range in which ghosts do not occur using the equation Y=sX+t, where the variable Y is the density of the reverse transfer ghost and the variable X is the transfer bias level. Since there are two unknowns s and t in this case, it is possible to identify s and t by learning the relationships between two sets of density levels for reverse transfer ghosts and transfer bias levels, and to identify a point P2 at which the density of the reverse transfer ghost reaches zero. Hence, the control section 90 forms test patterns corresponding to the two ghost generation levels B1 and B2, estimates a transfer bias level B0 at which the density of the reverse transfer ghost reaches zero based on the two ghost generation levels B1 and B2 and ghost density levels L3 and L4 of ghosts formed for each test pattern, and set the transfer bias level for forming images with the image-forming unit 20 to a value lower than this level (for example, an intermediate value between A0 and B0, as in FIG. 11(*a*)). It is possible to set a transfer bias level that more accurately reflects the environmental conditions.

It is noted that in the above description, an optimal transfer bias is found using a linear expression for the calculation. However, the transfer bias may be found using another equation such as a quadratic expression. Further, the number of measuring points A1 and A2 (31 and B2) may be three or more, rather than just two. In other words, it is possible to generate three or more types of ghosts using three or more ghost generation levels and to estimate the transfer bias level, at which ghosts will not be generated, based on all the density levels.

Figure 12A:
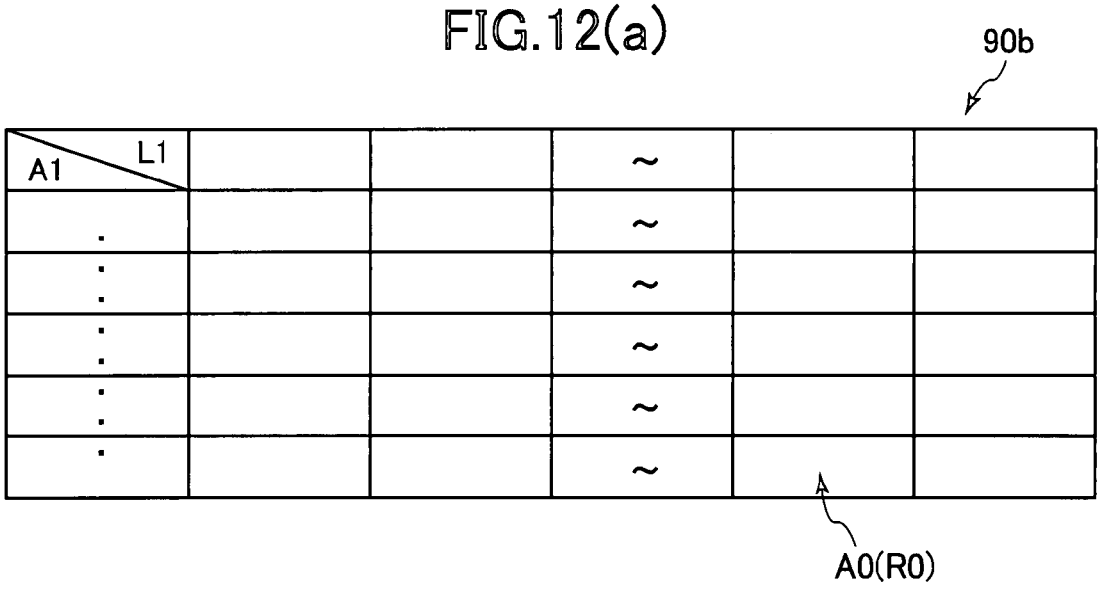
FIG. 12(*a*) illustrates an example of a table listing up a plurality of minimum transfer currents corresponding to a plurality of combinations of the transfer current and the density of ghosts left after transfer.
Figure 12B:
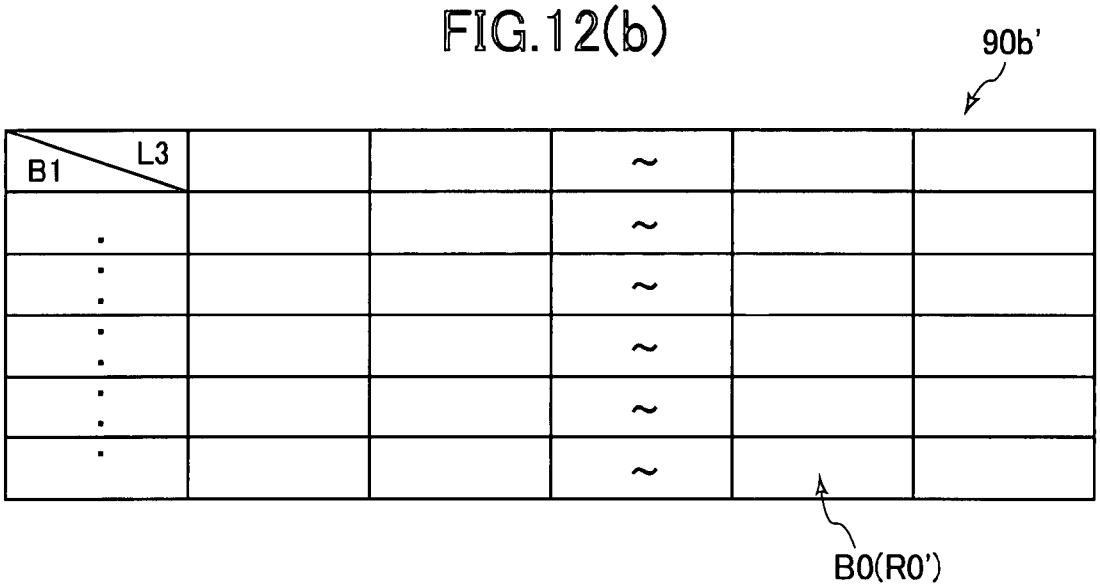

Or, the control section 90 may possess a table 90*b* shown in FIG. 12(*a*) that lists up a plurality of minimum transfer bias levels A0 as appropriate transfer bias levels for image formation in correspondence with a plurality of possible combinations of the ghost generation levels A1 and the ghost density levels L1. In this case, in 14.and S57, the control section 90 simply refers to the table 90*b*, selects the minimum transfer bias level A0 based on the ghost generation level A1 and the measured density level L1, and determines the selected minimum transfer bias level A0 as the appropriate transfer bias.

It is noted that the table 90*b* may list up a plurality of reference transfer bias levels R0 in place of the minimum levels A0 as appropriate transfer bias levels for image formation. The reference transfer bias levels R0 are reference levels for ranges in which ghosts will not occur. In this case, in S14 and S57, the control section 90 refers to the table 90*b*, selects the reference transfer bias level R0 based on the ghost generation level A1 and the measured density level L1, and determines an appropriate bias level by adding a predetermined amount of margin to the reference level R0.

Similarly, the control section 90 may possess a table 90*b*' shown in FIG. 12(*b*) that lists up a plurality of maximum transfer bias levels B0 as appropriate transfer bias levels for image formation in correspondence with a plurality of possible combinations of the ghost generation levels B1 and the ghost density levels L3. In this case, in S57, the-control section 90 simply refers to the table 90*b*', selects the maximum transfer bias level B0 based on the ghost generation level al and the measured density level L3, and determines the selected maximum transfer bias level B0 as the appropriate transfer bias.

It is noted that the table 90*b*' may list up a plurality of reference transfer bias levels R0' in place of the maximum levels B0 as appropriate transfer bias levels for image formation. The reference transfer bias levels R0' are reference levels for ranges in which ghosts will not occur. In this case, in S57, the control section 90 refers to the table 90*b*', selects the reference transfer bias-level R0' based on the ghost generation level B1 and the measured density level L3, and determines an appropriate bias level by adding a predetermined amount of margin to the reference level R0'.

As described above, according to the present embodiment, the control section 90 sets the transfer bias level, applied between the transfer roller 61 and the photosensitive drum 62 to the ghost generation level A1 or B1. The control section 90 forms a test pattern 73 on the sheet 3 at location C1 by applying a transfer bias set to the ghost generation level A1 or B1 in order to transfer a toner image of the test pattern 73 onto the sheet 3. When transferring the toner image onto the location C1 on the sheet 3 at this level, ghosts are formed at a location C2 of the sheet 3, which is shifted away from the location C1 upwardly in the sheet conveying direction by the circumferential length T of the photosensitive drum 62 and therefore which is located in the non-image-forming region N. The density sensor 71 detects the density of the toner image deposited at the location C2. The control section 90 estimates a transfer bias level A0 or B0 in which ghosts do not occur based on the ghost generation level A1 or B1 and the density level L1 or L3 of the toner image at the location C2, and sets the transfer bias level A0 or C0 (=(A0+B0)/2) as the transfer bias level for forming images.

Thus, the control section 90 can set an appropriate transfer bias level not to generate ghost images, by considering transfer bias levels at which ghost images are actually generated and the status of the actually formed ghost images deposited at the location C2 in the non-image-forming region N. With this construction, an accurate appropriate transfer bias can be set quickly.

The test pattern 73 need not be limited to that shown in FIG. 8, provided that each of the yellow, magenta, cyan, and black patterns can fit within one circumferential length T of the photosensitive drum 62. The pattern need not be a special test pattern, but may be any pattern that can be used for detecting ghosts.

If it is known that ghosts do not usually occur in an image-forming unit that is used first in the image forming process, that is, the image-forming unit 20Y positioned farthest upstream in the tandem type printer 1, this image-forming unit need not be the target of the ghost detecting process of FIG. 6 or the appropriate bias detecting processes of FIGS. 7 and 9.

<Modification>

The transfer bias setting process of FIGS. 6-9 may be modified in a manner described below with reference to FIGS. 14-15(*b*).

Figure 13A:
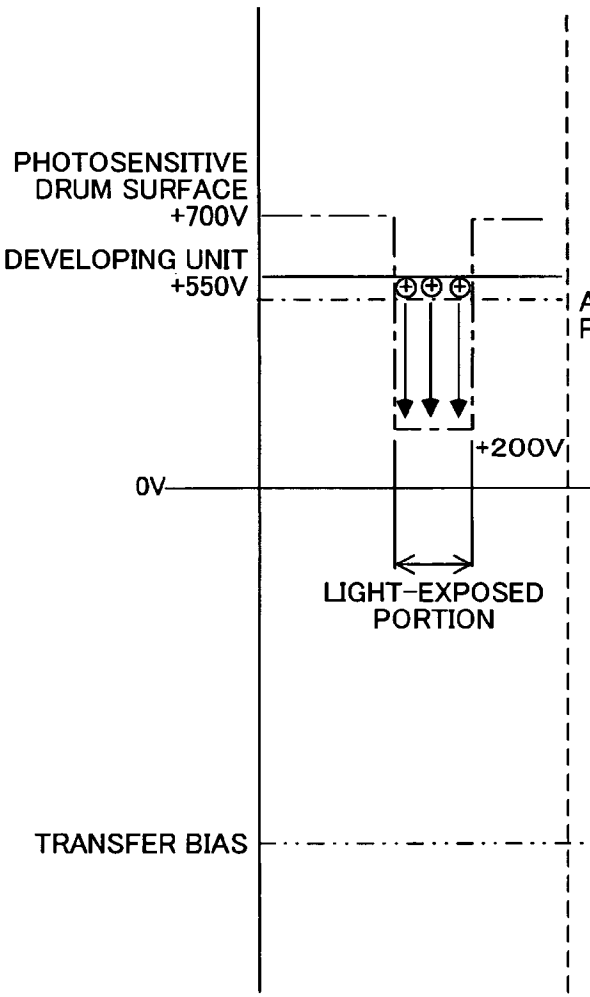
FIGS. 13(*a*) and 13(*b*) are explanatory diagrams showing examples of the electrical potential of each roller.
Figure 13B:
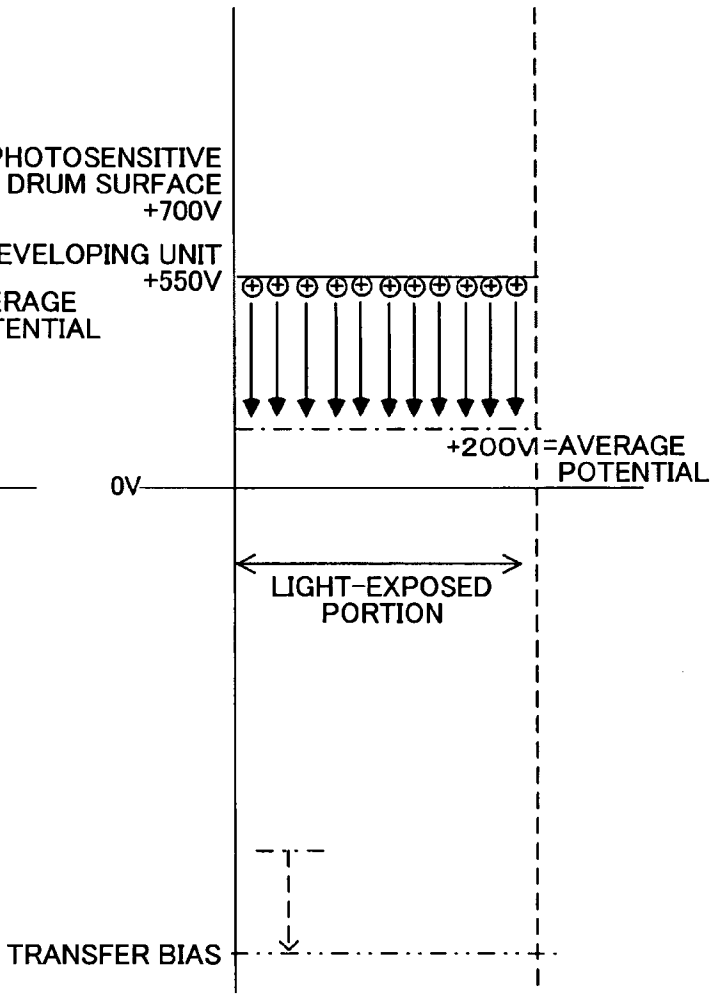

First, the process in which a toner image is transferred onto the paper 3 will be described in greater detail with reference to FIGS. 13(*a*) and 13(*b*). FIGS. 13(*a*) and 13(*b*) are explanatory diagrams showing the electric potentials of the respective rollers.

Since toner having a positive charge is applied to the developing roller 52, the toner is inclined to migrate from a high potential surface to a surface having a lower potential.

As shown in FIG. 13(*a*), toner migrates to exposed areas on the surface of the photosensitive drum 62 when coming into contact with this surface. As the photosensitive drum 62 rotates and the toner on the exposed areas contacts the paper 3 interposed between the transfer roller 61 and photosensitive drum 62, the toner transfers onto the paper 3 due to the potential difference between the exposed areas of the photosensitive drum 62 (+200 V) and the surface of the paper 3.

The potential of the paper 3 fluctuates along with fluctuations in the transfer bias. As described above, the transfer bias is controlled so that a constant amount of current flows to the transfer roller 61. Accordingly, the potential of the transfer roller 61 is influenced by the average potential at portions of the photosensitive drum 62 in contact with the transfer roller 61 (more accurately, the paper 3). Hence, if the average potential at portions of the photosensitive drum 62 in contact with the transfer roller 61 is low, then the potential of the transfer roller 61 will be lower. Likewise, if the average potential is high, the potential of the transfer roller 61 will be higher.

In the example of FIG. 13(*a*), the potential of the transfer roller 61 is high because the exposed surface area on the photosensitive drum 62 is small. In this case, the potential difference between the exposed areas of the photosensitive drum 62 and the transfer roller 61 is less, making it less likely that the toner image formed on the photosensitive drum 62 will transfer onto the paper 3.

Further, if the exposed image is a pattern of thin lines or the like, then the surface potential of the transfer roller 61 at areas opposing the exposed portions of the photosensitive drum 62 will be greater than when the exposed image is a broader pattern of the same total surface area, even when the potential in the shaft of the transfer roller 61 is the same, making the toner even less likely to transfer. This phenomenon occurs also when controlling the transfer bias with a constant voltage. Accordingly, by detecting a ghost image of attest pattern having thin lines after forming the same and setting the amount of a constant current to flow from the photosensitive drum 62 to the transfer roller 61 based on these detection results so that ghost images will not be generated based on the thin lines, it is possible to establish the lower limit of a transfer bias capable of ensuring that the toner image is reliably transferred.

In the example shown in FIG. 13(*b*), the entire surface of the photosensitive drum 62 is exposed, resulting in a low potential for the transfer roller 61. In this case, the potential difference between the exposed areas on the photosensitive drum 62 (+200 V) and the transfer roller 61 is great. Hence, by forming another test pattern over the entire area of the photosensitive drum 62 that contacts the transfer roller 61 and detecting ghost images of the test pattern, it is possible to detect ghosts that are generated by an excessively strong transfer bias.

Figure 14:
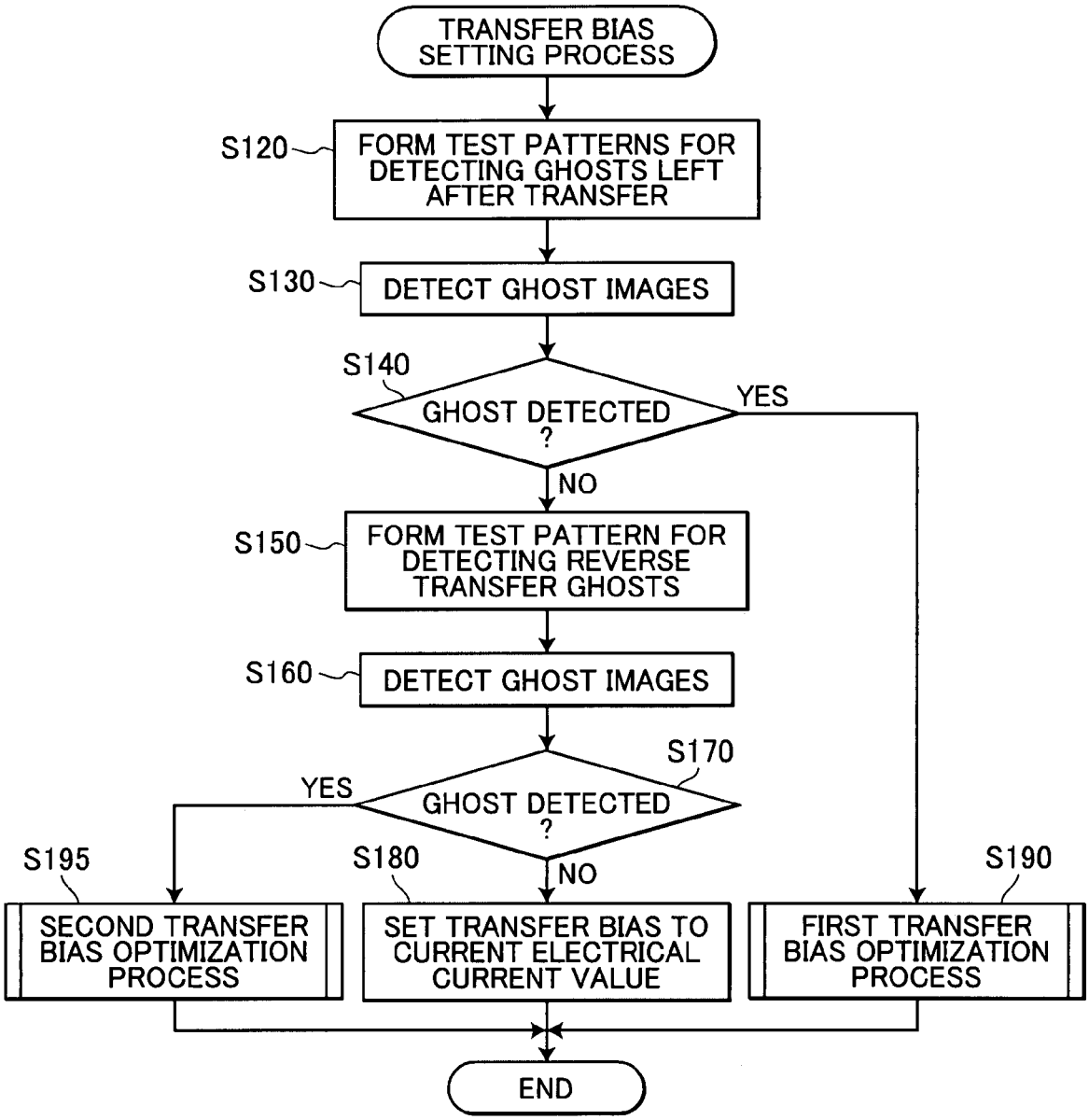
FIG. 14 is a flowchart illustrating steps in a transfer bias setting process according to a modification.

Next, a process for setting the transfer bias (transfer current value) will be described with reference to FIGS. 14 to 15(*b*) FIG. 14 is a flowchart showing steps in a transfer bias setting process executed by the control section 90 according to the present modification. FIG. 15(*a*) is a flowchart showing steps in a first transfer bias optimization process in the transfer bias setting process of FIG. 14. FIG. 15(*b*) is a flowchart showing steps in a second transfer bias optimization process in the transfer bias setting process of FIG. 14.

At the beginning of the transfer bias setting process in S120 of FIG. 14, the control section 90 determines whether a ghost left after transfer is generated according to the transfer bias conditions currently set for the image-forming units 20Y, 20M, 20C, and 20K. Specifically, in order to determine first whether the transfer bias at the yellow image-forming unit 20Y is suitable, the control section 90 forms a toner image of a predetermined test pattern 173Y for detecting a yellow ghost left after transfer. An example of the test pattern 173Y for yellow is shown in FIG. 16(*a*). A non-image-forming region N is formed following this test pattern 173Y, in which region no image is formed for at least one rotation of the photosensitive drum 62. In other words, the non-image-forming region N is defined on the upstream side of the test pattern 173Y in the sheet conveying direction and has a length equal to or greater than the circumferential length T of the photosensitive drum 62.

Next, in order to determine whether the transfer bias at the magenta image-forming unit 20M is suitable, the control section 90 forms a toner image on the paper 3 of a predetermined test pattern 173M for detecting magenta ghosts left after transfer. An example of a toner image for the magenta toner test pattern 173M is shown in FIG. 16(*b*). A non-image-forming region N is provided after this test pattern 173M, in which region no image is formed for at least one rotation of the photosensitive drum 62. This process is repeated in order to form a toner image of a cyan test pattern 173C with a subsequent non-image-forming region N, such as that shown in FIG. 16(*c*), for detecting cyan ghosts left after transfer, and for forming a toner image of a black test pattern 173K with a subsequent non-image-forming region N, such as that shown in FIG. 16(*d*) for detecting black ghosts left after transfer.

Of course the test patterns 173 (173Y, 173C, 173M, and 173K) of each color shown in FIGS. 16(*a*)-16(*d*) are determined so that the transfer biases applied to the transfer section in each image-forming unit 20 will be set within a suitable range but to be a weaker transfer bias within the suitable range in order to prevent changes in colors and color mixing caused by a reverse transfer, as well as the occurrence of reverse transfer ghosts.

FIG. 16(*a*) shows a sample test pattern 173Y for detecting a yellow ghost left after transfer. In this yellow test pattern 173Y, a plurality of (about twenty, in this example) thin lines 173YL are formed to extend in a direction orthogonal to the conveying direction of the paper 3. The thin lines 173YL are arranged at an interval of 1 mm in this example in the sheet conveying direction.

It is noted that the test pattern 173Y should be designed so that the test pattern 173Y can be detected by the density sensor 71. For example, the length of the thin lines 173YL (in the direction orthogonal to the conveying direction) is set to about 30 mm. It is noted that the maximum width of a toner image that can be formed on the paper 3 (maximum printing width) is about 200 mm, in this example. Accordingly, the length of the thin lines 173YL (in the direction orthogonal to the conveying direction) is set to a part of the maximum printing width. The width (the dimension parallel to the conveying direction) of each thin line 173YL is set to about 0.15 mm, much smaller than the width of the transfer nip region (about 2 mm) between the photosensitive drum 62 and the paper 3 (transfer roller 61).

FIG. 16(*b*) shows a sample test pattern 173M for detecting a magenta ghost left after transfer. Here, the control section 90 generates a solid yellow portion 173MS over the maximum printing width (about 200 mm in this example). In an intermediate region in the solid yellow portion 173MS with respect to a direction orthogonal to the conveying direction, the control section 90 generates a plurality of narrow red (R=Y+M) lines 173ML, which extend in the direction orthogonal to the conveying direction and which are arranged parallel to the conveying direction of the paper 3, by superimposing a plurality of magenta lines over the solid yellow portion 173MS. The red lines 173ML are formed in the same way as the yellow lines 173YL shown in FIG. 16(*a*). In this way, the solid yellow portion 173MS is formed covering the entire printing width, and the magenta lines 173ML are superimposed on top of the wide solid yellow portion 173MS, in order to increase the amount of charges that are being possessed by the toner while the yellow toner is being transferred. Toner can accumulate a charge more easily when the potential difference is greater. Accordingly, it is possible to check for ghosts under more severe conditions than when forming the plurality of magenta lines 173ML directly on the sheet 3 or when superimposing the magenta lines 173ML over a narrow solid portion.

FIG. 16(*c*) shows a sample test pattern 173C for detecting cyan ghosts left after transfer. Here, a solid yellow portion 173CS is formed across the maximum printing width (about 200 mm in this example). Subsequently, in an intermediate region in the solid yellow portion 173CS with respect to the direction orthogonal to the conveying direction, a plurality of red (R=Y+M) vertical lines 173CVL are formed by superimposing a plurality of thin magenta lines over the yellow solid portion 173CS to extend parallel with the conveying direction of the paper 3, and a plurality of green (G=M+C) horizontal lines 173CHL are formed by superimposing a plurality of thin cyan lines over the yellow solid portion 173CS to extend in a direction orthogonal to the conveying direction, thereby generating a grid pattern. A solid magenta pattern is superimposed over the solid yellow portion 173CS on either side of the intermediate region to form a solid red (R=Y+M) portion. The green horizontal lines 173CHL have the same shape as the yellow lines 173YL shown in FIG. 16(*a*) and the red lines 173ML shown in FIG. 16(*b*). The red vertical lines 173CVL are similar to the green lines 173CHL, except for the obvious vertical and horizontal directional difference.

A color formed by mixing yellow, magenta, and cyan (Y+M+C) is generated at intersecting points between the green horizontal lines 173CHL and the red vertical lines 173CVL in the intermediate region. By using this type of test pattern 173C, it is possible to predict that three colors may overlap due to positional deviations in the colors or the like, even when the original intention is to use only secondary colors (two superimposed colors) and not ternary colors (three superimposed colors). Hence, if the problem of color deviation or the like does not exist, the green and red lines 173CHL and 173CVL may be alternately formed as horizontal lines, for example.

FIG. 16(*d*) shows a sample test pattern 173K for detecting black ghosts left after transfer. In an intermediate region 173KI of the paper 3 with respect to the direction orthogonal to the conveying direction, dither patterns of yellow, magenta, and cyan are superimposed over each other at a density of about 60% each and a solid black test pattern is formed by superimposing black at a density of 100% over these colors. On either side of this intermediate region 173KI, a solid red (R=Y+M) portion 173KS is generated by superimposing a solid magenta test pattern over a solid yellow test pattern.

In S120 the control section 90 sequentially forms the test patterns 173 (173Y, 173M, 173C, and 173K) shown in FIGS. 16(*a*)-16(*d*) on the paper 3 by controlling the image forming operations of the image-forming units 20 (particularly exposure of the scanning units 41 for forming latent images). The control section 90 also forms the non-image-forming regions N directly following formation of each test pattern 173 over an interval equal to at least one circumferential length T of the photosensitive drum 62.

In S130 the density sensor 71 executes an operation to detect ghost images caused by each test pattern 173 in the corresponding non-image-forming region N.

In S140 the control section 90 determines whether a ghost image exists in the non-image-forming region N following each test pattern 173 (173Y, 173M, 173C, 173K).

More specifically, while the sheet 3 is being conveyed in the sheet conveying direction, the density sensor 71 confronts the non-image-forming region N. When the density sensor 71 detects a ghost for the color corresponding to the yellow, magenta, or cyan test pattern 173Y, 173M, or 173C in the corresponding non-image-forming region N, the control section 90 can acquire a pulse wave having a periodic output level from the density sensor 71 according to the conveyance of the paper 3. The control section 90 employs a discrete Fourier transform to analyze the frequency of the waveform outputted from the density sensor 71. The control section 90 determines that a yellow ghost image exists in the non-image-forming region N following the yellow test pattern 173Y when the frequency of the waveform, which the density sensor 71 outputs while confronting the subject non-image-forming region N, matches the frequency or interval, at which the lines 173YL are arranged in the yellow test pattern 173Y in the sheet conveying direction. The control section 90 determines that a magenta ghost image exists in the non-image-forming region N following the magenta test pattern 173M when the frequency of the waveform, which the density sensor 71 outputs while confronting the subject non-image-forming region N, matches the frequency or interval, at which the lines 173ML are arranged in the magenta test pattern 173M in the sheet conveying direction. The control section 90 determines that a cyan ghost image exists in the non-image-forming region N following the cyan test pattern 173C when the frequency of the waveform, which the density sensor 71 outputs while confronting the subject non-image-forming region N, matches the frequency, at which the lines 173CHL are arranged in the magenta test pattern 173C in the sheet conveying direction.

When the density sensor 71 detects a ghost for the color corresponding to the black test pattern 173K in the corresponding non-image-forming region N, the output from the density sensor 71 shows changes in density, whose period is the same as that of the yellow, magenta, and cyan dither patterns in the intermediate region 173KI or whose amount is greater than a predetermined threshold amount. Accordingly, the control section 90 determines that a black ghost exists in the non-image-forming region N following the black test pattern 173K when the output, which the density sensor 71 outputs while confronting the subject non-image-forming region N, changes with a period the same as that of the yellow, magenta, and cyan dither patterns in the intermediate region 173KI or changes with an amount exceeding the predetermined threshold amount.

If the control section 90 detects a ghost image for at least one of the yellow, magenta, cyan, and black test patterns 173Y, 173M, 173C, and 173K (yes in S140), the control section 90 advances to S190. However, when a ghost image is not detected for any test patterns 173Y, 173M, 173C, or 173K (no in S140), then the control section 90 advances to S150.

In S150 the control section 90 forms a test pattern 273 for detecting reverse transfer ghost images. Thus, in this modification, the control section 90 first determines whether a ghost left after transfer is generated for each color by using the test patterns 173 shown in FIGS. 16(*a*)-16(*d*). If a ghost left after transfer is not detected for any of the yellow, magenta, cyan, and black test patterns 173, then the control section 90 determines whether a reverse transfer ghost is generated.

Figure 17B:
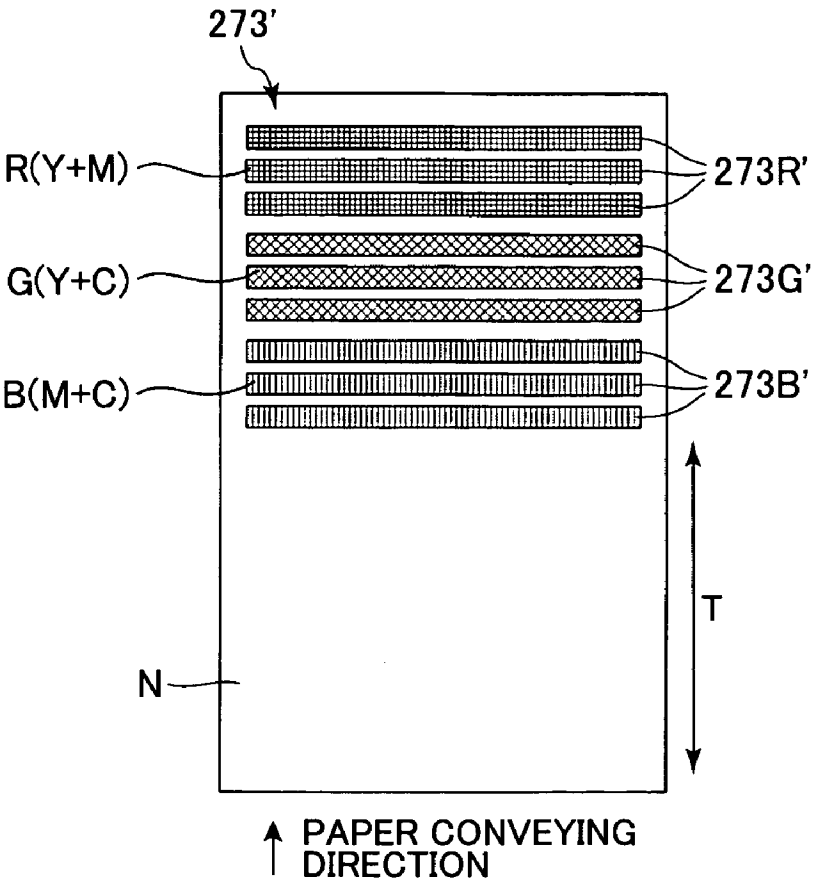
FIG. 17(*a*) is an explanatory diagram showing an example of a test pattern used for detecting reverse transfer toner.
Figure 17A:
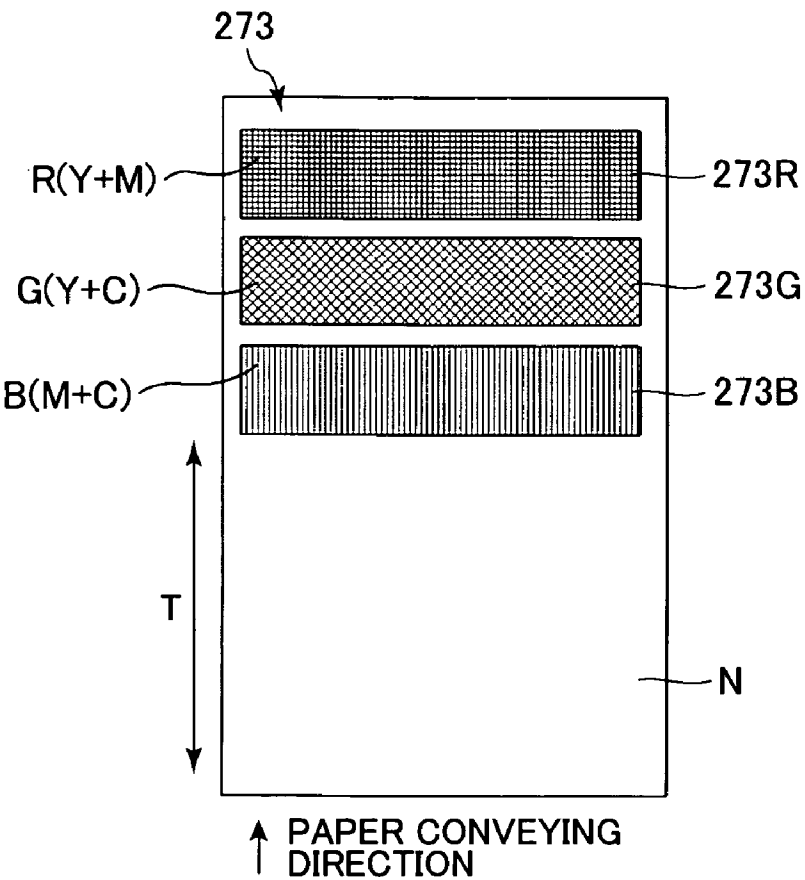

For example, the control section 90 forms, on the paper 3, a toner image of a test pattern 273 for detecting, reverse transfer ghosts shown in FIG. 17(*a*). Directly after the test pattern 273, the control section 90 forms a non-image-forming region N for an interval equivalent to at least one rotation of the photosensitive drum 62 in the same manner as the non-image-forming region N for each test pattern 173 for ghost left after transfer. That is, the non-image-forming region N is formed following the test pattern 273 by at least one circumferential length T of the photosensitive drum 62 in the sheet conveying direction.

As the test pattern 273, it is preferable to use test patterns in colors that tend to generate reverse transfer. Accordingly, in the present modification, the test pattern 273 used for detecting reverse transfer ghosts is formed in secondary colors rather than primary colors (that is, a combination of two rather than only one of the colors yellow, magenta, and cyan), as shown in FIGS. 17(*a*) and 17(*b*). This is because image regions, formed in the colors red, green, and blue (combination of two of the three toner colors of cyan, magenta, and yellow), are more likely to cause reverse transfer than the three toner colors of cyan, magenta, and yellow, per se.

FIG. 17(*a*) shows an example of the test pattern 273 for detecting a reverse transfer ghost. By combining two of the three colors yellow, magenta, and cyan in each possible combination, the control section 90 generates three solid portions 273R, 273G, and 2733 across the maximum printing width of the paper 3 in red (R=Y+M), green (G=Y+C), and blue (B=M+C). Each solid portion 273R, 273G, and 273B has a predetermined length in the paper conveying direction that is greater than the nip width (2 mm) (contact length) between the photosensitive drum 62 and the sheet 3 (transfer roller 61). Each solid portion 273R, 273G, and 273B extends over the maximum printing width (about 200 mm in this example) in the direction orthogonal to the paper conveying direction. A non-image-forming region N is formed on the paper 3 following the test pattern 273 in the sheet conveying direction, and extends by a length of at least one circumferential length T of the photosensitive drum 62. The length of the non-image-forming region N is equivalent to at least one rotation of the photosensitive drum 62.

It is noted that an additional non-image-forming region equivalent to one rotation of the photosensitive drum 62 (one circumferential length T) may be additionally formed between each of the test patterns 273R, 273G, and 273B.

In this example, each solid portion 273R, 273G, 273B is set to a length of approximately 17 mm, for example, in the paper conveying direction, which is greater than the nip width (2 mm) between the photosensitive drum 62 and the sheet 3 (transfer roller 61). The length of each solid portion 273R, 273G, 273B in the paper conveying direction may be shortened when the entire test pattern 273 does not fit within one rotation of the photosensitive drum 62 (one circumferential length T of the photosensitive drum 62). However, the length of each solid portion 273R, 273G, 273B in the paper conveying direction should be at least greater than the nip width between the photosensitive drum 62 and the sheet 3 (transfer roller 61).

FIG. 17(*b*) shows another example of the test pattern 273 (which will be referred to as test pattern 273' hereinafter)

that is suitably used when the reverse transfer phenomenon is more likely to occur the more boundaries there are between areas in which toner images are formed and areas in which toner images are not formed. The test pattern 273' has: a plurality of (three, in this example) red solid portions 273R'; a plurality of (three, in this example) green solid portions 273G'; and a plurality of (three, in this example) blue solid portions 273B'. The red solid portions 273R' are separated from one another in the sheet conveying direction, the green solid portions 273G' are separated from one another in the sheet conveying direction, and the blue solid portions 273B' are separated from one another in the sheet conveying direction. The length of each solid portion 273R', 273G', 273B' in the paper conveying direction should be set to about 4 mm and be greater than the nip width between the photosensitive drum 62 and the sheet 3 (transfer roller 61). The solid portion 273R', 273G', 273B' are spaced from one another at intervals of about 4 mm. Each solid portion 273R', 273G', 273B' extends over the maximum printing width (about 200 mm in this example) in the direction orthogonal to the paper conveying direction. The test pattern 273' in FIG. 17(*b*) is effective for accurately detecting the occurrence of ghost images using the discrete Fourier transform or the like. A non-image-forming region N is formed on the paper 3 following the test pattern 273' in the sheet conveying direction, and extends by a length of at least one circumferential length T of the photosensitive drum 62. The length of the non-image-forming region N is therefore equivalent to at least one rotation of the photosensitive drum 62.

In S160 the density sensor 71 performs an operation to detect reverse transfer ghosts caused by the test pattern 273 (or 273') in the non-image-forming region N. When using the test pattern 273 of FIG. 17(*a*), the control section 90 determines that a reverse transfer ghost exists in the non-image-forming region N when the change in density exceeds a certain amount in the same manner as when detecting the black ghost left after transfer in S140. When using the test pattern 273' of FIG. 17(*b*), the control section 90 determines that a reverse transfer ghost exists in the non-image-forming region N when the frequency of output from the density sensor 71 matches the frequency or interval, at which the solid portions 273R', 273G', 273B' are arranged in the sheet conveying direction.

In S170 the control section 90 determines whether a ghost is detected in S160.

If a ghost is detected (yes in S160), then the control section 90 advances to S195. However, if a ghost is not detected (no S160), the control section 90 advances to S180.

In S180 the control section 90 determines that the current transfer biases (values of the transfer electric current) for all the colors are suitable and that no adjustment is needed. Hence, the control section 90 does not change the transfer biases and ends the process.

In S190, however, the control section 90 performs a first transfer bias optimization process for eliminating the occurrence of ghost images, and subsequently ends the process. In the first transfer bias optimization process of S190, as shown in FIG. 15(*a*), the control section 90 calibrates the transfer current value (the value of the constant current), setting the value of the current to achieve an optimal transfer bias.

In S195, the control section 90 performs a second transfer bias optimization process for eliminating the occurrence of ghost images, and subsequently ends the process. In the second transfer bias optimization process of S195, as shown in FIG. 15(*b*), the control section 90 also calibrates the transfer current value (the value of the constant current), setting the value of the current to achieve an optimal transfer bias.

The test patterns 173 for detecting ghosts left after transfer shown in FIGS. 16(*a*)-16(*d*) are primarily used to check whether the transfer bias is too small and, hence, are test patterns for "insufficient transfer bias". Further, the test pattern 273 or 273' for detecting reverse transfer ghosts shown in FIG. 17(*a*) or 17(*b*) is primarily used for checking whether the transfer bias is too large and, therefore, can be called a test pattern for "excessive transfer bias."

Figure 15A:
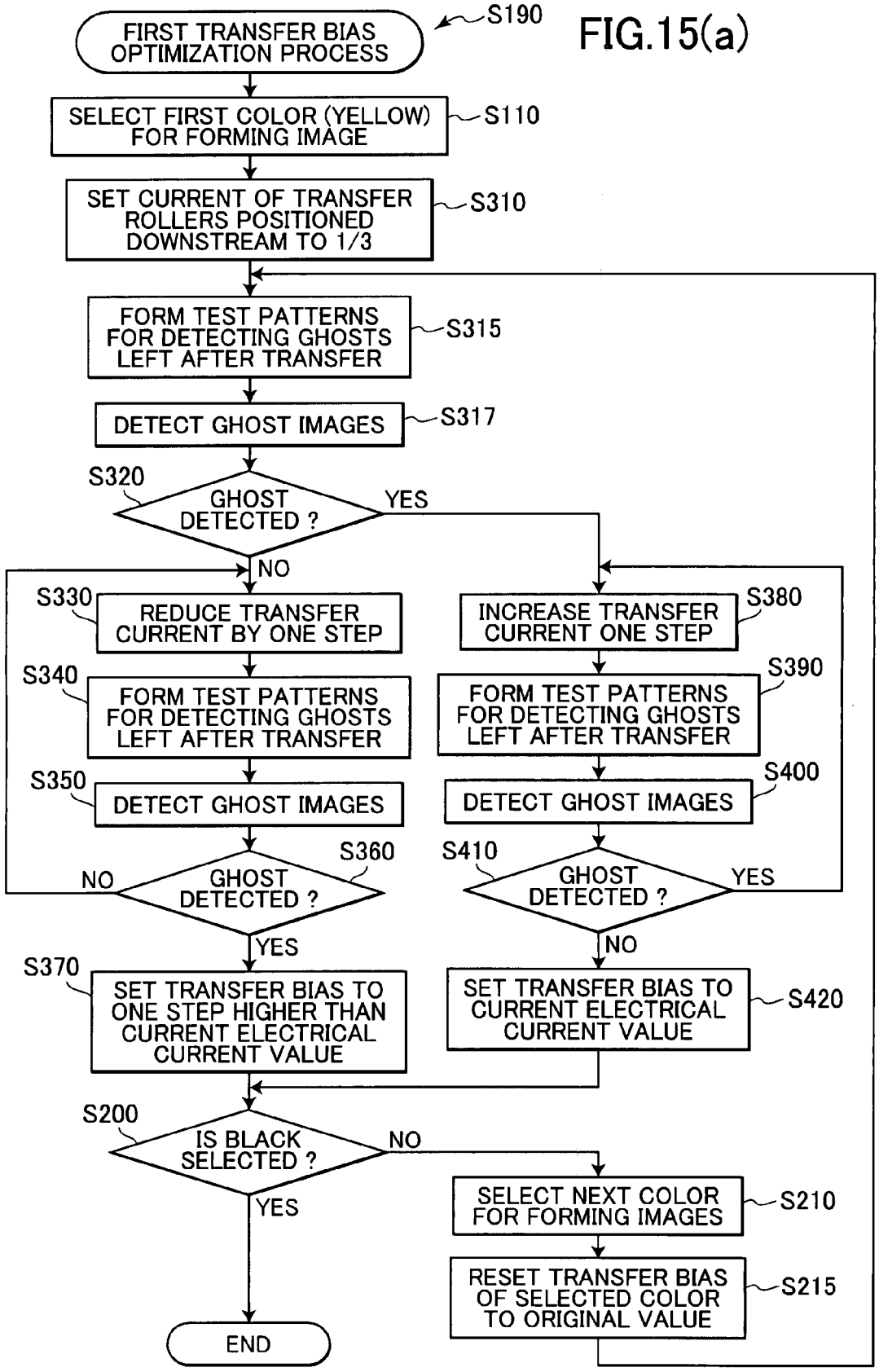
FIG. 15(*a*) is a flowchart illustrating steps in a first transfer bias optimization process in the transfer bias setting process of FIG. 14.
Figure 16A:
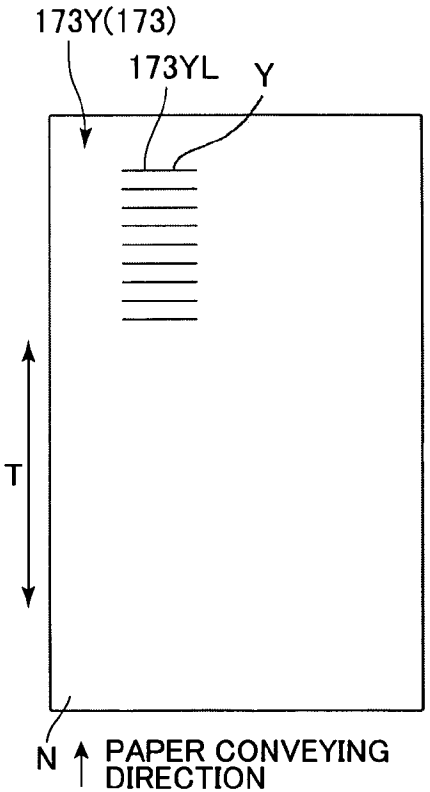
FIG. 16(*a*) is an explanatory diagram showing a test pattern used for detecting yellow toner left after transfer.
Figure 16B:
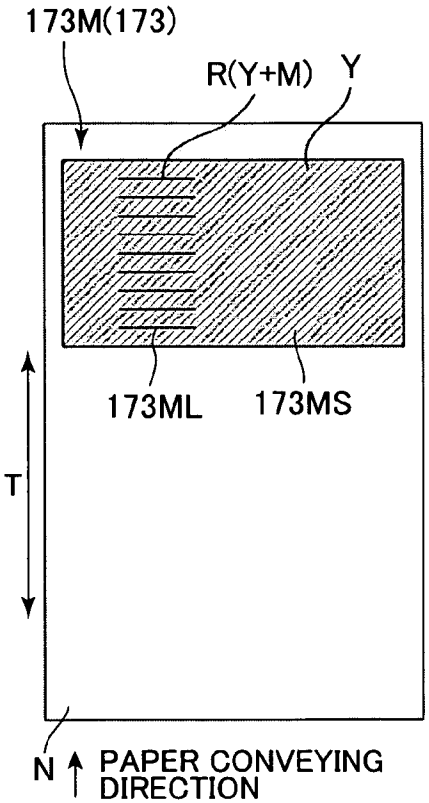
Figure 16C:
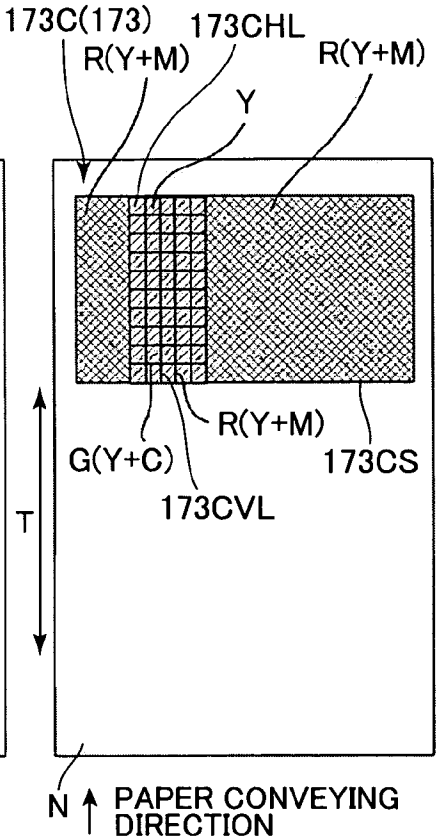
Figure 16D:
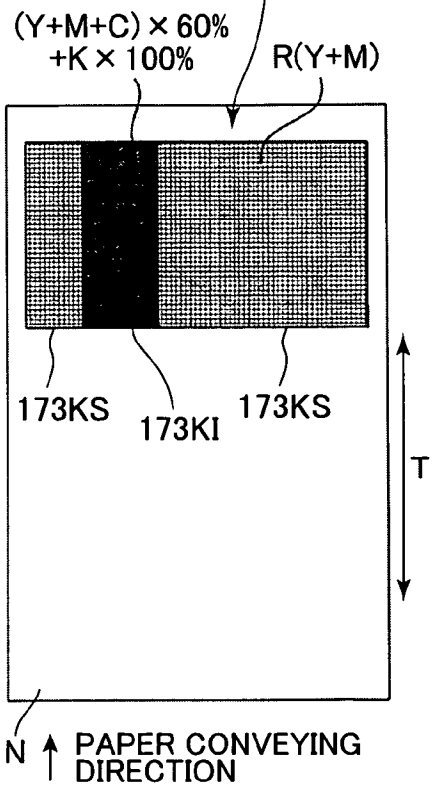

FIG. 15(*a*) illustrates in greater detail the first transfer bias optimization process described above in S190 of the transfer bias setting process in FIG. 14.

At the beginning of the first transfer bias optimization process in S110 of FIG. 15(*a*), the control section 90 selects yellow as the color of the image-forming unit 20 that first generates a color image in the normal print mode. It is noted that the yellow image-forming unit 20Y is positioned farthest upstream with respect to the paper conveying direction.

In S310 the control section 90 decreases the transfer bias for the transfer roller 61 of each color positioned downstream of the currently selected color in the paper conveying direction. More specifically, the control section 90 reduces the transfer current to about one-third (for example, from 15 μA to 5 μA) of the present value.

In S315 the control section 90 forms a test pattern 173 for detecting toner left after transfer shown in FIG. 16(*a*), 16(*b*), 16(*c*), or 16(*d*), and subsequently forms a non-image-forming region N equivalent to at least one circumferential length T of the photosensitive drum 62.

More specifically, when forming the test pattern 173, the control section 90 uses the image-forming unit 20 of the currently selected color and the color upstream of the currently selected color. More specifically, when yellow is selected, the control section 90 forms the test pattern 173Y shown in FIG. 16(*a*). When magenta is selected, the control section 90 forms the test pattern 173M shown in FIG. 16(*b*). When cyan is selected, the control section 90 forms the test pattern 173C shown in FIG. 16(*c*). When black is selected the control section 90 forms the test pattern 173K shown in FIG. 16(*d*).

In S317 the density sensor 71 performs an operation to detect ghost images left after transfer that are generated in the non-image-forming region N following the test pattern 173. In S320 the control section 90 determines whether a ghost image has been detected in S317. The control section 90 advances to S380 if a ghost image has been detected and advances to S330 if not.

If the control section 90 determines in S320 that a ghost image has not been detected, then in S330 the control section 90 reduces the transfer current one step because a weaker transfer bias is preferable for more effectively preventing reverse transfers, even though the present transfer electric current is within a suitable range.

In S340-S360, the control section 90 repeats the processes the same as those of S315-S320 described above. If a ghost image is not detected in S360, then the control section 90 returns to S330. However, the control section 90 advances to S370 when a ghost image is detected in S360.

If a ghost image is generated as a result of reducing the transfer current one step in S330, then it is known that the transfer current has been lowered too far. Accordingly, in S370 the control section 90 sets the amount of the constant current for use in the normal print mode to the electric current value one step greater than the currently selected transfer electric current, and advances to S200.

However, if a ghost image has been detected in S320, then in S380 the control section 90 reduces the transfer current by one step to prevent the generation of ghost images.

In S390-S410 the control section 90 performs processes identical to those in S315-S320. If a ghost image is detected in S410, the control section 90 returns to S380 and repeats the process. However, if a ghost image is not detected in S410, then it is known that the transfer current falls within a suitable range.

In S420 the control section 90 sets the constant current value for use in the normal print mode to the currently set transfer electric current and advances to S200.

In S200 the control section 90 determines whether black, the color of the last image-forming unit 20 for generating a color image in the normal print mode, has been selected. If black has not been selected, then in S210 the control section 90 selects the color positioned directly downstream of the currently selected color for generating a color image in the normal print mode. In S215 the control section 90 returns the transfer bias for the image-forming unit 20 of the color selected in S210 to its original setting. In other words, the control section 90 returns the transfer current value that has been reduced to one-third in S310 to its original setting. Subsequently, the control section 90 returns to S315 and repeats the process described above.

According to the process described above, when the color newly selected in S210 is magenta, then a suitable transfer bias is set for the magenta image-forming unit 20M by generating in S315 the test pattern 173M shown in FIG. 16(*b*) for detecting magenta ghosts left after transfer. When cyan is next selected in S210, a suitable transfer bias is set for the cyan image-forming unit 20C by generating in S315 the test pattern 173C shown in FIG. 16(*c*) for detecting cyan ghosts left after transfer. Finally, when black is selected in S210, a suitable transfer bias is set for the black image-forming unit 20K by generating in S315 the test pattern 173K shown in FIG. 16(*d*) for detecting black ghosts left after transfer.

After completing the first transfer bias optimization process of S190 described above for each of the image-forming units 20, the control section 90 determines YES in S200, since black has been the last color selected in S210, and the process of FIG. 15(*a*) ends.

FIG. 15(*b*) illustrates in greater detail the second transfer bias optimization process described above in S195 of the transfer bias setting process in FIG. 14.

At the beginning of the second transfer bias optimization process in S1110 of FIG. 15(*b*), the control section 90 selects yellow as the color of the image-forming unit 20 that first generates a color image in the normal print mode.

In S1310 the control section 90 decreases the transfer bias for the transfer roller 61 of each color positioned downstream of the currently selected color in the paper conveying direction. More specifically, the control section 90 reduces the transfer current to about one-third (for example, from 15 μA to 5 μA) of the present value.

In S1315 the control section 90 forms a test pattern 273 or 273' for detecting reverse transfer ghost shown in FIG. 17(*a*) or 17(*b*), and subsequently forms a non-image-forming region N equivalent to at least one circumferential length T of the photosensitive drum 62.

In S1317 the density sensor 71 performs an operation to detect reverse ghost images that are generated in the non-image-forming region N-following the test pattern 273 or 273'. In S1320 the control section 90 determines whether a ghost image has been detected in S1317. The control section 90 advances to S1380 if a ghost image has been detected (yes in S1320) and advances to S1330 if not (no in S1320).

If the control section 90 determines in S1320 that a ghost image has not been detected, then in S1330 the control section 90 increases the transfer current one step.

In S1340-S1360, the control section 90 repeats the processes the same as those of S1315-S1320 described above. If a ghost image is not detected in S1360, then the control section 90 returns to S1330. However, the control section 90 advances to S1370 when a ghost image is detected in S1360.

If a ghost image is generated as a result of increasing the transfer current one step in S1330, then it is known that the transfer current has been increased too far. Accordingly, in S1370 the control section 90 sets the amount of the constant current for use in the normal print mode to the electric current value one step smaller than the currently selected transfer electric current, and advances to S1200.

However, if a ghost image has been detected in S1320, then in S1380 the control section 90 reduces the transfer current by one step to prevent the generation of ghost images.

In S1390-S1410 the control section 90 performs processes identical to those in S1315-S1320. If a ghost image is detected in S1410, the control section 90 returns to S1380 and repeats the process. However, if a ghost image is not detected in S1410, then it is known that the transfer current falls within a suitable range.

In S1420 the control section 90 sets the constant current value for use in the normal print mode to the currently set transfer electric current and advances to S1200.

In S1200 the control section 90 determines whether black, the color of the last image-forming unit 20 for generating a color image in the normal print mode, has been selected. If black has not been selected, then in S1210 the control section 90 selects the color positioned directly downstream of the currently selected color for generating a color image in the normal print mode. In S1215 the control section.90 returns the transfer bias for the image-forming unit 20 of the color selected in S1210 to its original setting. In other words, the control section 90 returns the transfer current value that has been reduced to one-third in S1310 to its original setting. Subsequently, the control section 90 returns to S1315 and repeats the process described above.

According to the process described above, also when the color newly selected in s1210 is magenta, then a suitable transfer bias is set for the magenta image-forming unit 20M by generating in S1315 the test pattern 273 or 273' shown in FIG. 17(*a*) or 17(*b*). Also when cyan is next selected in S1210, a suitable transfer bias is set for the cyan image-forming unit 20C by generating in S1315 the test pattern 273 or 273' shown in FIG. 17(*a*) or 17(*b*). Finally, when black is selected in S1210, a suitable transfer bias is set for the black image-forming unit 20K by generating in S1315 the test pattern 273 or 273' shown in FIG. 17(*a*) or 17(*b*).

After completing the second transfer bias optimization process of S195 described above for each of the image-forming units 20, the control section 90 determines YES in S1200, since black has been the last color selected in S1210, and the process of FIG. 15(*b*) ends.

It is noted that the solid portion 173MS in FIG. 16(*b*), the solid portion 173CS in FIG. 16(*c*), the black test pattern 173K (intermediate portion 173KI and both-side solid portions 173KS) in FIG. 16(*d*), the solid portions 273R, 273G, 273B in FIG. 17(*a*), and the solid portions 273R', 273G', 273B' in FIG. 17(*b*) extend over the maximum printing width (about 200 mm in this example) in the direction orthogonal to the paper conveying direction. However, it is sufficient that the solid portions 173MS, 173CS, 273R, 273G, 273B, and 273R', 273G', 273B' and the black test pattern 173K may extend over nearly the maximum printing width in the direction orthogonal to the paper conveying direction. That is, it is sufficient that the solid portions 173MS, 173CS, 273R, 273G, 273B, and 273R', 273G', 2733' and the black test pattern 173K may extend over the majority of the maximum width in which a developer image can be formed. In other words, it is desirable that the solid portions 173MS, 173CS, 273R, 273G, 273B, and 273R', 273G', 273B' and the black test pattern 173K may occupy a region 80% or greater of the entire width of the sheet 3.

In the printer 1 described above, the control section 90 forms a toner image on the paper 3 as a test-pattern 173, 273, or 273' and forms a non-image-forming region N in the area directly after this toner image for at least one circumferential length T of the photosensitive drum 62. The density sensor 71 then detects whether toner pattern corresponding to the test pattern 173, 273, or 273' exists in the non-image-forming region N. In addition, the control section 90 sets image forming conditions in the form of a transfer bias for each of the image-forming units 20 based on the results of detection by the density sensor 71 to prevent the generation of ghost images.

Hence, the printer 1 can detect whether ghosts are generated in images actually formed on the paper 3 and can then set suitable image forming conditions.

By detecting the existence of toner in the non-image-forming region N directly after the toner image of the test pattern 173, 273, or 273', the control section 90 can detect ghosts more accurately in this region, thereby improving the system for measuring toner.

Further, the control section 90 forms a plurality of patterns 173YL, 173ML, 173CHL, 273R', 273G', and 273B' at intervals. When the density sensor 71 detects toner at intervals matching the test pattern intervals, the control section 90 determines that ghost exists on the paper 3 and sets image forming conditions accordingly.

Hence, since the printer 1 detects toner based on intervals in which the patterns 173YL, 173ML, 173CHL, 273R', 273G', and 273B' are formed, the printer 1 can reliably identify the position at which the density sensor 71 detects toner when toner is detected in the non-image-forming region N. Since the control section 90 need only analyze results of detections from this identified position, the control section 90 can easily and reliably detect toner that exists in the non-image-forming region N.

By using the line patterns 173YL, 173ML, 173CHL of FIGS. 16(*a*)-16(*c*) and solid patterns 273R', 273G', and 273B' of FIGS. 17(*a*) and 17(*b*), generation of ghost images can be determined when toner is detected in the non-image-forming region N at the same period or interval as the test pattern period or interval. Accordingly, the occurrence of ghost images can be easily and reliably detected and clearly differentiated from noise and dirt or the like on the sheet 3.

Further, the transfer roller 61 transfers a toner image onto the paper 3 according to a transfer bias applied between the transfer roller 61 and photosensitive drum 62 at the transfer position. The control section 90 forms the test patterns 173MS, 173CS, 173KI, and 173KS of FIGS. 16(*a*)-16(*c*), solid patterns 273R, 273G, and 273B of FIG. 17(*a*), and solid patterns 273R', 273G', and 273B' of FIG. 17(*b*) having a length in the direction parallel to the sheet conveying direction greater than the length in the same direction of the contact portion (nip portion) between the paper 3 and the photosensitive drum 62 at the transfer position.

Accordingly, a lot of toner is deposited at the transfer nip part, which is the contact portion between the photosensitive drum 62 and the sheet 3 on the transfer roller 61. In this case, a positively charged toner is used and a transfer bias is applied using constant current control. Accordingly, the potential applied to the transfer roller 61 is reduced in order to ensure a constant current. Accordingly, there occurs a great potential difference between the surface area of the photosensitive drum 62 at which toner is deposited and the sheet 3 on the transfer roller 61.

It is possible to find an upper limit of the transfer bias that should be applied between the transfer roller 61 and the photosensitive drum 62.

It is noted that even if a negatively charged toner is used, it is still possible to find an upper limit of the transfer bias that should be applied between the transfer roller 61 and the photosensitive drum 62, although the polarity of the potential of the transfer roller 61 relative to the photosensitive drum 62 is opposite to that in the case where a positively charged toner is used.

Each of the solid portions 273R, 273G, 2733, 273R', 273G', and 273B' in FIGS. 17(*a*)-17(*b*) has lengths in the direction parallel to the sheet conveying direction greater than the length in the same direction of the contact portion (nip part) between the photosensitive drum 62 and the paper 3 on the transfer roller 61 at the transfer position, and has widths, in the direction orthogonal to the relative movement direction, large enough to occupy nearly the maximum width of the paper 3 in which a toner image can be formed. Hence, the printer 1 can accurately determine the upper limit of the transfer bias.

When forming the test patterns 273R, 273G, 273B in FIG. 17(*a*) having the above-described size or the test pattern 273R', 273G', and 273B' in FIG. 17(*b*) having the above-described size, the control-section 90 reduces in S1390 the transfer bias applied between the transfer roller 61 and photosensitive drum 62 at the transfer position when the control section 90 determines in S1320 that toner exists at the non-image-forming region N based on detection results by the density sensor 71. Accordingly, it is possible to set a transfer bias that prevents a toner image from being formed in the non-image-forming region N.

The control section 90 forms the plurality of line patterns 173YL, 173ML, 173CHL shown in FIGS. 16(*a*)-16(*c*), which are arranged substantially parallel to one another such that the length of each line in the direction parallel to the conveying direction of the paper 3 is shorter than the length of the contact portion (nip portion) between the paper 3 and the photosensitive drum 62 at the transfer position in the same direction.

By forming the line patterns 173YL, 173ML, 173CHL with the above-described sizes only a small amount of toner is deposited at the transfer nip part. Because a positively charged toner is used and the transfer bias is applied through constant current control, then the potential applied to the transfer roller 61 rises. Accordingly, there occurs a smaller potential difference between the surface area of the photosensitive drum 62 on which toner has been deposited and the sheet 3 on the transfer roller 61. Hence, it is possible to find an appropriate lower limit of the transfer bias to be applied between the transfer roller 61 and photosensitive drum 62.

It is noted that even if a negatively charged toner is used, it is still possible to find a lower limit of the transfer bias that should be applied between the transfer roller 61 and the photosensitive drum 62, although the polarity of the potential of the transfer roller 61 relative to the photosensitive drum 62 is opposite to that in the case where a positively charged toner is used.

Additionally, the line patterns 173YL, 173ML, 173CHL have their lengths in the direction orthogonal to the sheet conveying direction occupying a portion of the length of a contact portion between the paper 3 and the photosensitive drum 62 at the transfer position in the same direction. It is possible to accurately determine a lower limit for the transfer bias.

When forming the line patterns 173YL, 173ML, 173CHL, the control section 90 increases in S380 the transfer bias applied between the transfer roller 61 and photosensitive drum 62 at the transfer position when the control section 90 determines in S320 that toner exists in the non-image-forming region N based on detection results by the density sensor 71. Hence, it is possible to set a suitable transfer bias that prevents toner from being detected in the non-image-forming region N.

By using the line patterns 173YL, 173ML, 173CHL, the control section 90 repeatedly executes image forming operations of S380-S400 while increasing the transfer bias and sets in S420 the transfer bias for use in forming images to the transfer bias that has been used at the time toner is not detected in the non-image-forming region N. Hence, the printer 1 can set a suitable transfer bias without increasing the bias unnecessarily.

By using the line patterns 173YL, 173ML, 173CHL, the control section 90 reduces in S330 the transfer bias applied between the transfer roller 61 and photosensitive drum 62 at the transfer position when the control section 90 determines in S320 that no toner exists in the non-image-forming region N based on detection results by the density sensor 71. Hence, the printer 1 can set a suitable transfer bias without increasing the transfer bias unnecessarily.

By using the line patterns 173YL, 173ML, 173CHL, the control section 90 repeatedly executes the image forming operation of S330-S360 while controlling the transfer bias applied between the transfer roller 61 and the photosensitive drum 62 at the transfer position to a lower value, and sets in S370 the transfer bias for forming images with the image-forming unit to the last transfer bias at which no toner has been found in the non-image-forming region N before the control section 90 detects toner in this region N (yes in S360). Hence, the printer 1 can set a suitable transfer bias without unnecessarily increasing the bias.

Each of the test patterns 173C and 173M in FIGS. 16(*b*) and 16(*c*) has at least one area where a plurality of toner colors are superimposed one on another. By forming the test patterns 173C and 173M having such a pattern, it is ensured that toner does not easily transfer onto the sheet 3 at a position at which other toner has already been formed, because the current toner is affected by the charges of toner already positioned on the sheet 3. Ghost images are more likely to occur because the transfer bias becomes too strong. Hence, the printer 1 can set a transfer bias that prevents toner from being detected in the non-image-forming region N under severe conditions.

In the test pattern 173M shown in FIG. 16(*b*), the plurality of lines 173ML, which are arranged substantially parallel to one another at the contact portion between the photosensitive drum 62 and paper 3, are developed by the corresponding developing roller 52M, after the solid pattern 173MS having a size that covers the plurality of lines 173ML is developed by an upstream side developing roller 52Y. Similarly, in the test pattern 173C in FIG. 16(*c*), the plurality of lines 173CHL, which are arranged substantially parallel to one another at the contact portion between the photosensitive drum 62 and paper 3, are developed by the corresponding developing roller 52C after the solid pattern 173CS having a size that covers the plurality of lines 173CHL is developed by an upstream side developing roller 52Y. Hence, the printer 1 can set severe conditions when forming the line patterns 173ML and 173CL.

The printer 1 forms images by superimposing toner images of each developing roller 52 in sequence. The control section 90 selects in S110 (S1110) the developing roller 52Y to be first used for forming an image and performs an image forming operation a plurality of times using the first developing roller 52Y. After detection using the density sensor 71 has been completed, the control section 90 selects in S210 (S1210) the next developing roller 52 to be used in sequence, and performs the image forming operation using this next developing roller 52. The density sensor 71 detects the existence of toner in each non-image-forming region N each time the control section 90 completes an image forming operation using each developing roller 52.

Since the printer 1 can form test images in the same order as an actual image forming operation, the printer 1 can set a transfer bias with consideration for the effect of actually superimposing toner images formed by different developing rollers 52.

When forming a test pattern with each of the photosensitive drums 62Y, 62M, and 62C, the control section 90 reduces in S310 (51310) the original or present transfer bias applied between at least one pair of photosensitive drum 62 and transfer roller 61 that is positioned downstream of the subject photosensitive drum 62Y, 62M, or 62C.

Hence, when forming the test pattern, the printer 1 can eliminate the effects of the transfer roller 61 positioned downstream. Formation of the test pattern at each transfer roller 61 is affected by the subject transfer roller 61 and other one or more transfer roller 61 positioned on the upstream side. Accordingly, the printer 1 can set an appropriate transfer bias for each transfer roller 61.

During the toner density calibrating mode, the control section 90 receives outputs from the optical sensor 71, and determines, based on the outputs from the optical sensor 71, whether or not the positions of the toner images formed by the respective developer cartridges 51 deviate or shift from one another. In other words, the optical sensor 71 also functions as a registration sensor for detecting deviations in the positions of toner images formed by the developer cartridges 51. Accordingly, the printer 1 can reduce costs by not requiring the provision of an additional registration sensor.

During the toner density calibrating mode, the control section 90 receives outputs from the optical sensor 71, and calibrates the density of toner images based on the outputs from the optical sensor 71. In other words, the optical sensor 71 also functions as a density sensor for measuring the density of test patterns used in calibrating the density of images formed by the image-forming units 20. Hence, the printer 1 can reduce costs by not requiring the provision of an additional density sensor.

During the toner density calibrating mode, the control section 90 performs the transfer bias setting process of FIGS. 14-15(*b*) after performing-the process of calibrating the density of images formed by the image-forming units 4. Accordingly, the printer 1 can efficiently set an appropriate transfer bias by adjusting the transfer bias during the density calibration process.

The test patterns 173 for detecting ghosts left after transfer need not be limited to those'shown in FIGS. 16(*a*)-16(*d*), provided that each of the yellow, magenta, cyan, and black patterns can fit within one circumferential length T of the photosensitive drum 62. The test patterns 273 and 273' for detecting reverse transfer ghosts need not be limited to those shown in FIGS. 17(*a*)-17(*b*), provided that each pattern can fit within one circumferential length T of the photosensitive drum 62. These patterns need not be special test patterns, but may be any pattern that can be used for detecting ghosts.

Further, the first transfer bias optimization process of S190 repeatedly forms test patterns in S320-S420 until the electric current value for controlling the transfer bias reaches an appropriate value. Similarly, the second transfer bias optimization process of S195 repeatedly forms test patterns in S1320-S1420 until the electric current value for controlling the transfer bias reaches an appropriate value.

However, the process may instead calculate an appropriate bias based on the densities of ghost images for two test patterns. For example, in the ghost detecting process of S320, the control section 90 may detect the amount of ghost image generated and set the electric current value by referencing a table (database provided in the ghost calibration process program) as shown in FIG. 12(*a*) or 12(*b*) based on the detection results. More specifically, in place of the first transfer bias optimization process of S190, S195, the control section 90 may perform a process to set a transfer bias current value by referencing the table of FIG. 12(*a*) or 12(*b*) according to the amount of ghost generated and to the present transfer bias. This method can simplify the transfer bias optimization processes and conserve the number of sheets of paper 3 used for the transfer bias setting process.

In the above description, the first and second transfer bias optimization processes of S190 and S195 are executed for all image-forming units 20 when the occurrence of a ghost is detected for even one of the colors yellow, magenta, cyan, and black. However, it is unnecessary to perform this process for all image-forming units 20. For example, if a yellow ghost is detected (yes in S140), the first or second transfer bias optimization process of S190 or S195 is performed for all image-forming units 20. However, when a cyan ghost is detected, it is unnecessary to perform the optimization process of S190 or S195 for the yellow image-forming unit 20Y and magenta image-forming unit 20M positioned on the upstream side of the cyan image-forming unit 20C. Hence, the currently set transfer electric current values may be left unchanged for the yellow image-forming unit 20Y and magenta image-forming unit 20M, while the transfer bias optimization process of S190 or S195 is performed only for the cyan image-forming unit 20C and black image-forming unit 20K.

Further, if it is known that ghosts do not usually occur in an image-forming unit that is used first in the image forming process, such as the image-forming unit 20Y positioned farthest upstream in the tandem type printer 1, this image-forming unit need not be the target of the ghost detecting process of FIG. 14 or the transfer bias optimization processes of FIGS. 15(*a*) and 15(*b*).

In other words, if the image-forming units 20Y, 20M, or 20C, which is located in the upstream side of the farthest downstream image-forming unit 20K, generates few ghost images, then that image-forming unit 20Y, 20M, or 20C may be excluded as a target for detecting the existence of toner.

Further, if the image-forming unit 20M, 20C, or 20K, which is located in the downstream side of the farthest upstream image-forming unit 20Y, generates ghost images, then it is desirable to reset the transfer bias at the ghost-generating image-forming unit 20M, 20C, or 20K and at any image-forming units that are located in the downstream side of the ghost-generating image-forming unit 20M, 20C, or 20K.

Because the photosensitive drum 62 has an endless structure with the prescribed circumference T, the existence of toner can be detected in the non-image-forming region N that is formed when the photosensitive drum 62 is rotated at least one time and therefore that has a length equal to or greater than the circumference T. The non-image-forming region N may be such a region that is formed when the photosensitive drum 62 is rotated one or more times and therefore that has a length equal to the integral multiple of the circumference T, and a ghost image may be detected at a location that is shifted from the location of the test pattern by the integral multiple of the circumference T.

<Other Modifications>

In the above-described embodiment and modification, the printer 1 is of a direct tandem type in a horizontal arrangement. However, the printer 1 can be modified into any other types. For example, the photosensitive drum 62 may be modified into a belt shape. Or, the photosensitive drum 62 may transfer toner images onto the paper 3 via an intermediate transfer medium in a belt shape or a drum shape.

The density sensor 71 is configured to read the density of the paper 3 positioned on the conveying belt 68, but is not limited to this configuration. For example, using the direct tandem method, the printer 1 may transfer a test pattern onto the conveying belt 68 rather than the paper 3 and detect the generation of ghosts using the density sensor 71. If the printer 1 is modified to be provided with the intermediate transfer medium described above, the density sensor 71 may be disposed near this intermediate transfer medium for reading the density of ghost images generated on the medium.

Figure 18:
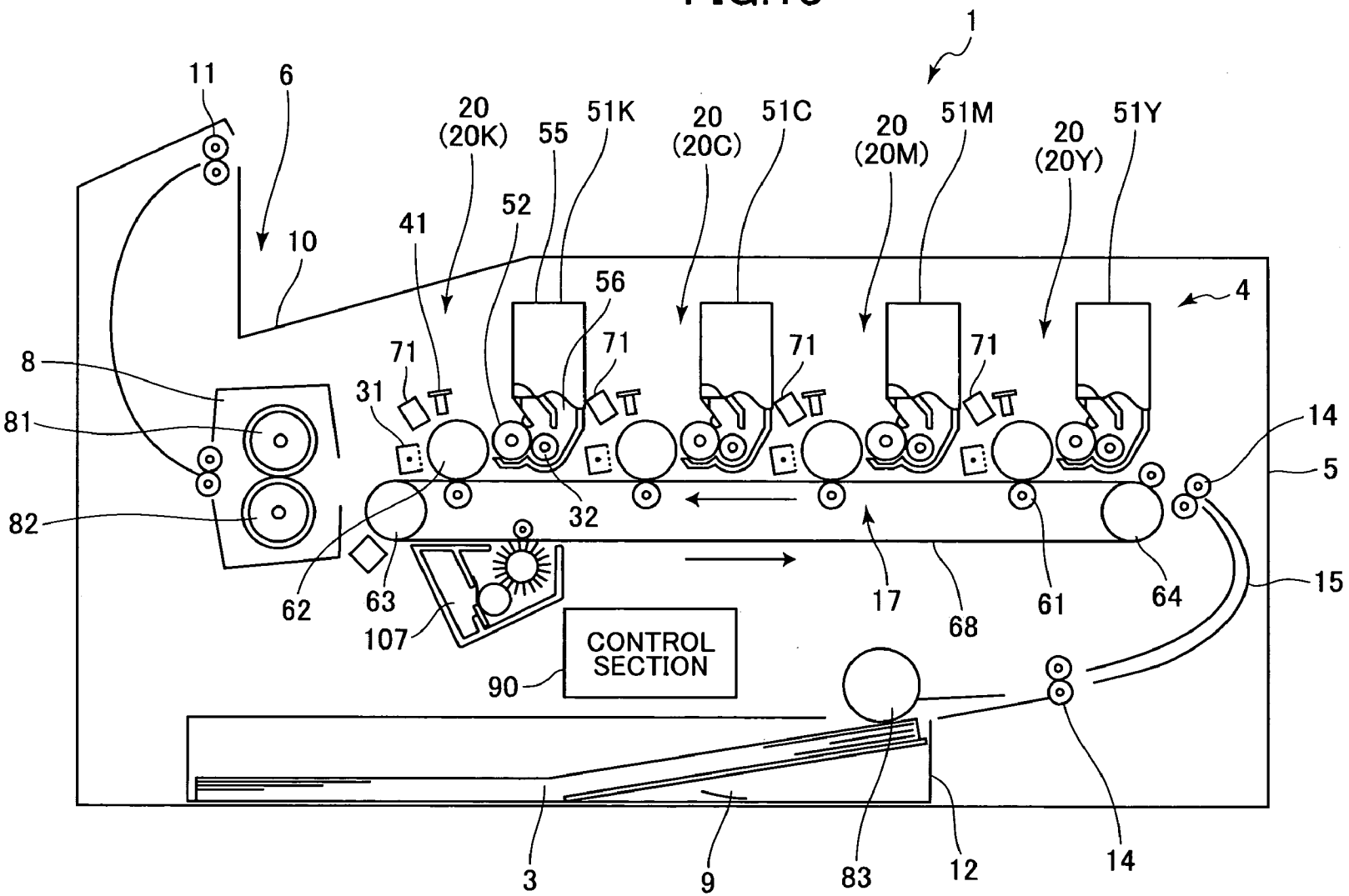
FIG. 18 is a cross-sectional view showing details of a printer according to a variation of the first embodiment.

Further, the control method described above is not limited to controlling the occurrence of ghost images. For example, as shown in FIG. 18, the density sensor 71 may be disposed near each photosensitive drum 62 for detecting toner left on each photosensitive drum 62 after a transfer.

While the printer 1 sets image forming conditions by controlling the transfer bias applied to the transfer rollers 61, the printer 1 is not limited to this configuration. For example, the printer 1 may set image forming conditions by controlling the electrical characteristics of the charger 31, scanning unit 41, developing roller 52, and the like.

It is noted that the printer 1 includes the plurality of developing rollers 52 (52Y, 52M, 52C, 52K) for forming toner images. The control section 90 performs an image forming operation sequentially with each developing roller 52 to form a toner image of a test pattern. Further, the density sensor 71 detects the existence of toner in a non-image-forming region N defined after each test pattern. If the results of these detections shows that some image-forming unit 20 including the charger 31, the scanning unit 41, the developing roller 52, and the transfer roller 61 forms ghost images, the control section 90 may set image forming conditions for at least one of the charger 31, scanning unit 41, developing roller 52, and transfer roller 61 that constitute the ghost-generating image-forming unit 20.

Hence, the printer 1 having the plurality of developing rollers 52 can appropriately prevent the occurrence of ghosts left after transfer and reverse transfer ghosts.

Second Embodiment

Next, a printer 2 according to a second embodiment of the present invention will be described.

The printer 2 according to the second embodiment differs from the printer 1 according to the first embodiment only in the configuration of the image-forming units 20. The remaining construction is identical to the printer 1 of the first embodiment. Accordingly, only those portions different from the printer 1 of the first embodiment will be described in detail in the second embodiment. Further, like parts and components are designated by the same reference numerals to avoid duplicating description.

Figure 19:
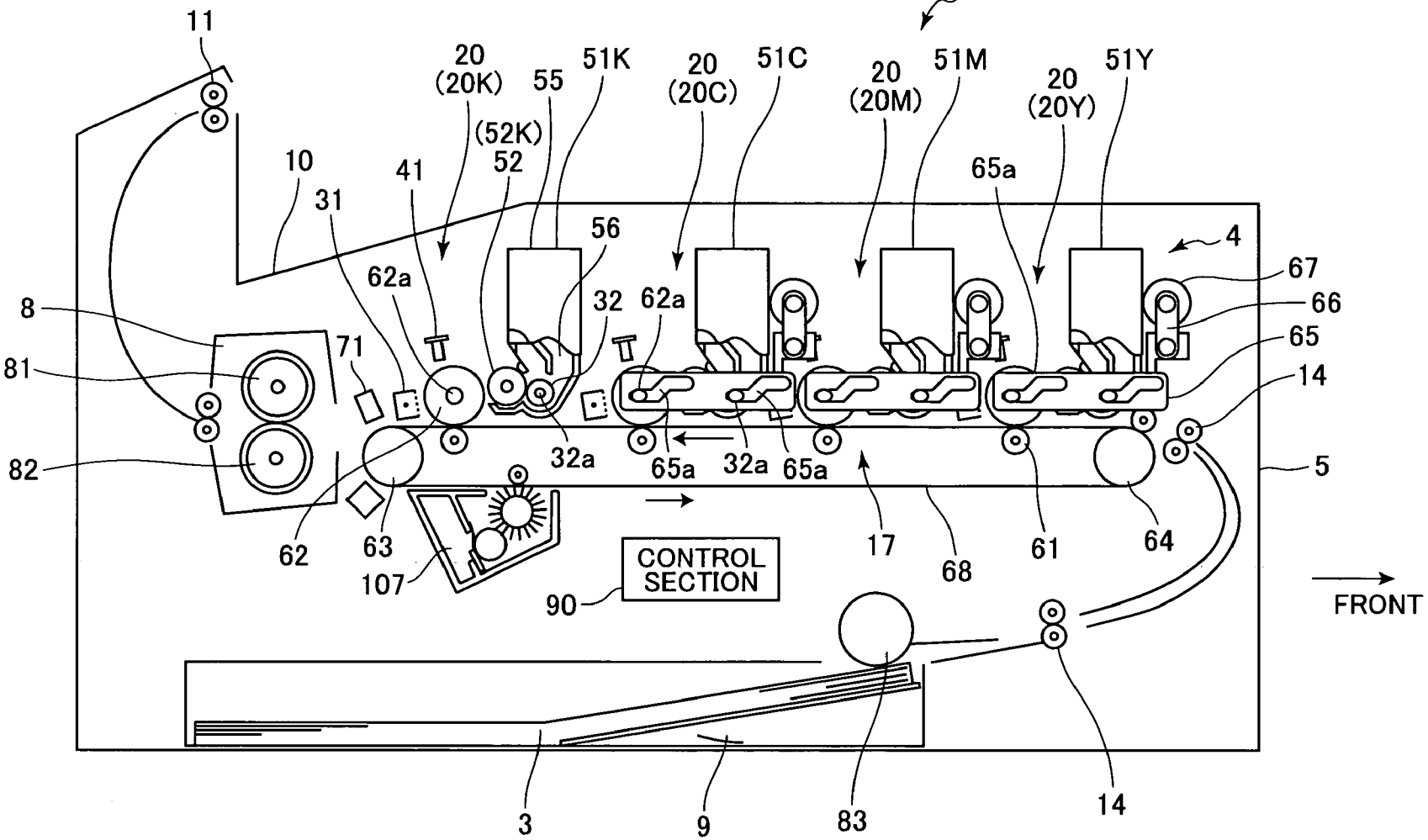
FIG. 19 is a cross-sectional view showing details of a printer according to a second embodiment of the present invention.

The image-forming units 20 in the second embodiment will be described while referring to FIG. 19. Each image-forming unit 20 in the printer 2 of the second embodiment is capable of moving vertically so that the photosensitive drum 62 provided in the image-forming unit 20 can be placed in contact with or separated from the conveying belt 68. Here, the entire image-forming unit 20 including the photosensitive drum 62, developer cartridge 51, and the like is configured to move as one unit.

Each of the image-forming units 20 includes: a moving member 65 having two guide holes 65*a*, in which a roller shaft 62*a* of the photosensitive drum 62 and a roller shaft 32*a* of the supply roller 32 are inserted; a link 66 coupled with the moving member 65 and capable of rotating with respect to the moving member 65; and a motor 67 (or a rotating solenoid) that rotates the link 66, causing the moving member 65 to move in a substantially horizontal direction (front-and-rear direction). The moving member 65, link 66, and motor 67 have been omitted from the black image-forming unit 20K in the drawing.

Each motor 67 is configured as part of the developer cartridge mechanism 72 shown in FIG. 2. Accordingly, the control section 90 controls driving of this motor 67 via the main drive unit 79.

When the control section 90 drives the motor 67, the moving member 65 moves rearwardly via the link 66. At this time, the two shafts 62*a* and 32*a* move upward within the guide holes 65*a* of the moving member 65, causing the photosensitive drum 62 to separate from the conveying belt 68.

In this way, the control section 90 executes an operation to move the photosensitive drum 62 and supply roller 32 upward in S310 and S1310, instead of reducing the bias controlling current to one-third of the original amount. This operation is performed only on the image-forming units 20 positioned downstream of the selected color.

The printer 2 according to the second embodiment described above separates, from the paper 3, all the photosensitive drums 62 positioned downstream of the photosensitive drum 62 with which the control section 90 is forming a test pattern.

Hence, the printer 2 according to the second embodiment can prevent toner deposited in a non-image-forming region N from being contacted with downstream-side photosensitive drums 62 until the toner has been detected by the density sensor 71, thereby enabling a more suitable transfer bias setting.

While the invention has been described in detail with reference to the specific embodiments thereof, it would be apparent to those skilled in the art that various changes and modifications may be made therein without departing from the spirit of the invention.

For example, the printers 1 and 2 in the above-described embodiments are configured as color laser printers, but are not limited to those configurations. For example, the printers 1 and 2 may be modified into monochromatic laser printers that prevent-generation of ghosts left after transfer.

In the preferred embodiments described above, a positively charged toner is used as the developer; but a negatively charged toner may be used in place of the positively charged toner.

Transparency sheet or the like can be used instead of the recording paper 3.

The transfer bias between the photosensitive drum 62 and the transfer roller 61 can be controlled according to a constant voltage control instead of the constant current control.

What is claimed is:

1. An image-forming device comprising:

a conveying member conveying a recording medium in a relative movement direction with respect to an image-forming unit;

the image-forming unit performing an image-forming operation, the image-forming unit comprising:

a photosensitive member;

a charging unit that charges the photosensitive member;

an exposing unit that forms an electrostatic latent image on the photosensitive member;

a developing unit that develops the electrostatic latent image on the photosensitive member into a visible developer image by using a developer agent on the photosensitive member; and a transferring unit that transfers the developer image from the photosensitive member to a transfer member at a predetermined transfer position, the transfer member being either one of the recording medium and the conveying member; and a control unit that performs an operation to determine image-forming conditions, the control unit comprising:

a test pattern forming unit that forms a developer image of a test pattern on the transfer member by controlling the image-forming unit to perform an image forming operation to form an electrostatic latent image of the test pattern at a part of the photosensitive member, to develop the electrostatic latent image of the test pattern into a visible developer image of the test pattern, and to transfer the developer image of the test pattern onto the transfer member at its test-image-forming region, a non-test-image-forming region being defined on the transfer member at a location that is different from the test-image-forming region;

a ghost image detecting unit that detects at least a part of the non-test-image-forming region of the transfer member; and an image-forming condition setting unit that sets image-forming conditions for at least one of the charging unit, the exposing unit, the developing unit, and the transferring unit based on detection results by the ghost image detecting unit, wherein the non-test-image-forming region corresponds to at least a part of the photosensitive member that includes the part of the photosensitive member, on which the test pattern has been formed, wherein the test pattern forming unit forms the non-test-image-forming region on the transfer member by controlling the exposing unit to form no electrostatic latent image on the at least a part of the photosensitive member including the part of the photosensitive member, on which the test pattern has been formed, after controlling the exposing unit to form the electrostatic latent image of the test pattern on the part of the photosensitive member.

2. An image-forming device according to claim 1, wherein the non-test-image-forming region has a part that contacts the part of the photosensitive member, on which the developer image of the test pattern has been formed.

3. An image-forming device according to claim 1, wherein the image-forming condition setting unit determines whether or not a ghost image is generated on the non-test-image-forming region based on the detection results by the ghost image detecting unit.

4. An image-forming device according to claim 1, wherein the photosensitive member has a photosensitive surface of an endless structure with a predetermined circumference and rotates in a rotational direction;

the conveying member conveys the transfer member in the relative movement direction that matches the rotational direction at a location where the transferring unit transfers a developer image from the photosensitive member onto the transfer member; and the non-test-image-forming region extends from the test-image-forming region by a length equal to at least one circumferential length of the photosensitive member in a direction opposite to the relative movement direction.

5. An image-forming device according to claim 1, wherein the test pattern forming unit periodically forms a plurality of test patterns at a predetermined interval in the relative movement direction; and the image-forming condition setting unit determines that a ghost image is formed on the non-test-image-forming region when the ghost image detecting unit detects developer at a period matching the interval of the test pattern.

6. An image-forming device according to claim 1, wherein the transferring unit transfers the developer image onto the transfer member by generating a transfer bias to the transferring unit with respect to the photosensitive member at the transfer position; and the test pattern forming unit forms a test pattern having a length in the direction parallel to the relative movement direction greater than the length of a contact portion between the photosensitive member and the transfer member at the transfer position in the relative movement direction.

7. An image-forming device according to claim 6, wherein the test pattern has a length in the direction orthogonal to the relative movement direction that occupies nearly a maximum width of a developer image that can be formed on the transfer member.

8. An image-forming device according to claim 6, wherein the image-forming condition setting unit reduces the transfer bias when determining that a ghost image is generated in the non-image-forming region.

9. An image-forming device according to claim 1, wherein the transferring unit transfers the developer image to the transfer member by applying a transfer bias to the transferring unit with respect to the photosensitive member at the transfer position; and the test pattern forming unit forms a plurality of test patterns arranged parallel to one another and having lengths in the direction parallel to the relative movement direction shorter than the length in the relative movement direction of a contact portion between the photosensitive member and the transfer member at the transfer position.

10. An image-forming device according to claim 9, wherein the test pattern has a length in the direction orthogonal to the relative movement direction that occupies a portion of the length in the relative movement direction of the contact portion between the photosensitive member and the transfer member at the transfer position.

11. An image-forming device according to claim 9, wherein the image-forming condition setting unit increases the transfer bias when determining that a ghost image is generated in the non-test-image-forming region.

12. An image-forming device according to claim 11, wherein the image-forming condition setting unit controls the test pattern forming unit to repeatedly execute a test-pattern developer image forming operation while increasing the transfer bias, and sets the value of a transfer bias for forming images to the value of the transfer bias at the time the image-forming condition setting unit determines that no ghost image is generated in the non-test-image-forming region.

13. An image-forming device according to claim 9, wherein the image-forming condition setting unit reduces the transfer bias when determining that no ghost image is generated in the non-test-image-forming region.

14. An image-forming device according to claim 13, wherein the image-forming condition setting unit controls the test pattern forming unit to repeatedly perform the test-pattern developer image forming operation while reducing the transfer bias, and sets the value of a transfer bias for forming images to the value of the last transfer bias at which no developer has been detected in the non-test-image-forming region before developer is first detected in the non-test-image-forming region.

15. An image-forming device according to claim 1, wherein the image-forming unit has a plurality of developing units, each of which forms a developer image by using a corresponding type of developer;

wherein the control unit performs the image-forming conditions determining operations by using the developing units sequentially, thereby allowing the image-forming condition setting unit to set image-forming conditions for at least one of the charging unit, the exposing unit, the transferring unit, and the developing units.

16. An image-forming device according to claim 15, wherein the control unit performs the image-forming conditions determining operations by controlling the test pattern forming unit to control the image-forming unit to form a developer image of a test pattern that has, in its at least one portion, a composite image made of at least two types of developer.

17. An image-forming device according to claim 16, wherein the plurality of developing units include first and second developing units, and wherein the control unit controls the test pattern forming unit to control the image-forming unit to form a plurality of first test patterns, which are arranged parallel to one another at a contact portion between the photosensitive member and the transfer member, by using the first developing unit, and to form a second test pattern by using the second developing unit before the first developing unit develops the plurality of first test patterns, the second test pattern having a size that covers the plurality of first test patterns.

18. An image-forming device according to claim 15, wherein the image-forming unit includes a plurality of image-forming units, which are arranged in a predetermined order in the relative movement direction, each image-forming unit including a photosensitive member, an exposing unit, a developing unit, and a transferring unit, the plurality of image-forming units forming a composite image by performing their image-forming operations sequentially in the predetermined order to superimpose developer images developed by their developing units; and wherein the control unit performs the image-forming conditions determining operation onto the image-forming units in the predetermined order.

19. An image-forming device according to claim 18, wherein the control unit performs the image-forming conditions determining operation onto each image-forming unit downstream from an image-forming unit provided the farthest upstream by using the subject image-forming unit and all the at least one image-forming unit located in the upstream side of the subject image-forming unit to form a composite image of the test pattern, the all the at least one upstream image-forming unit and the subject image-forming unit forming images of the test pattern sequentially in an order the same as the predetermined order, in which the all the at least one upstream image-forming unit and the subject image-forming unit are arranged, to form the composite image.

20. An image-forming device according to claim 18, wherein when performing the image-forming conditions determining operation onto one image-forming unit, the control unit reduces, from an original bias setting, the transfer bias for each image-forming unit that is located downstream of the subject image-forming unit in the relative movement direction.

21. An image-forming device according to claim 18, further comprising a separating unit that separates the photosensitive member away from the transfer member in each image-forming unit, and wherein when performing the image-forming conditions determining operation onto one image-forming unit, the control unit actuates the separating unit to separate the photosensitive member away from the transfer member in each image-forming unit that is located downstream of the subject image-forming unit in the relative movement direction.

22. An image-forming device according to claim 18, wherein the ghost image detecting unit includes:

a light-emitting unit that irradiates light onto the transfer member; and a light-receiving unit that receives light reflected from the transfer member, the image-forming condition setting unit determines, based on the detection result, whether or not a ghost image is generated in the non-test-image-forming region.

23. An image-forming device according to claim 22, wherein the control unit further detects, based on the detection results, positional variations of developer images formed by the plurality of image-forming units.

24. An image-forming device according to claim 22, wherein the control unit further detects density of developer images formed by the image-forming unit based on the detection signal.

25. An image-forming device according to claim 24, wherein the control unit performs the image-forming conditions determining operation after calibrating the density of developer images formed by the image-forming unit.

26. An image-forming device according to claim 1, further comprising a ghost generation level setting unit that sets a transfer bias level applied between the transferring unit and the photosensitive member to a ghost generation level capable of generating a ghost image on the transfer member, wherein the test pattern forming unit forms the developer image of the test pattern on the transfer member by applying the transfer bias set to the ghost generation level between the transferring unit and the photosensitive member, thereby generating a ghost image on the transfer member at the non-test-image-forming region, wherein the ghost image detecting unit includes a status detecting unit that detects a status of the ghost image formed in the non-test-image-forming region, and wherein the image-forming condition setting unit includes an image formation level setting unit that sets a transfer bias level for forming images based on the ghost generation level and the status of the ghost image.

27. An image-forming device according to claim 26, wherein the photosensitive member has a photosensitive surface of an endless structure with a predetermined circumference and rotates in a rotational direction;

the conveying member conveys the transfer member in the relative movement direction that matches the rotational direction at a location where the transferring unit transfers a developer image from the photosensitive member onto the transfer member; and the ghost image is generated on the transfer member at a location separated from the test-image-forming region by a length equal to one circumferential length of the photosensitive member in a direction opposite to the relative movement direction.

28. An image-forming device according to claim 26, wherein the status detecting unit includes a density detecting unit that detects a density level of the ghost image; and the image formation level setting unit sets the transfer bias level for forming images based on the ghost generation level and the ghost density level indicating the density level of the ghost image.

29. An image-forming device according to claim 28, wherein the ghost generation level setting unit sets a single ghost generation level;

the test pattern forming unit forms a developer image of a test pattern by applying the ghost generation level between the transferring unit and the photosensitive member, thereby generating a single ghost image; and the density detecting unit detects the ghost density level of the single ghost image; and the image formation level setting unit sets the transfer bias level for image formation based on the single ghost generation level and the detected single ghost density level.

30. An image-forming device according to claim 28, wherein the ghost generation level setting unit sets a plurality of different ghost generation levels;

the test pattern forming unit forms a plurality of developer images of a test pattern by applying the plurality of ghost generation levels between the transferring unit and the photosensitive member, thereby generating a plurality of ghost images;

the density detecting unit detects the ghost density levels of the plurality of ghost images; and the image formation level setting unit sets the transfer bias level for image formation based on the plurality of ghost generation levels and the detected ghost density levels.

31. An image-forming device according to claim 28, wherein the image formation level setting unit sets the transfer bias level for image formation by calculating a predetermined formula that indicates a relationship between the ghost generation level and the ghost density level.

32. An image-forming device according to claim 28, wherein the image formation level setting unit stores therein a table that lists up a plurality of transfer bias levels in correspondence with a plurality of combinations of the ghost generation level and the ghost density level.

33. An image-forming device according to claim 28, wherein the image formation level setting unit stores therein a table that lists up a plurality of reference levels in correspondence with a plurality of combinations of the ghost generation level and the ghost density level, each reference level indicating a corresponding transfer bias level.

34. An image-forming device according to claim 28, wherein developer remaining on the photosensitive member after the transferring unit has transferred a developer image of the test pattern from the photosensitive member to the transfer member is deposited as a first ghost image in the non-test-image-forming region of the transfer member;

the ghost generation level setting unit sets a first level for generating the first ghost image to the transfer bias level;

the test pattern forming unit forms a developer image of the test pattern by applying a transfer bias set to the first level to the transfer member, thereby generating the first ghost image, the density detecting unit detecting the density level of the first ghost image; and the image formation level setting unit sets the transfer bias level for image formation based on the first level and the density level of the first ghost image.

35. An image-forming device according to claim 34, wherein the image-forming unit includes a plurality of image-forming units that are arranged in the relative movement direction;

wherein the ghost generation level setting unit sets the transfer bias level to the first level for generating the first ghost image in either one of the plurality of image-forming units that is provided on an upstream side of an image-forming unit provided farthest downstream in the relative movement direction;

the test pattern forming unit controls the either one of the image-forming unit on the upstream side to form the developer image of the test pattern by applying a transfer bias of the first level to the transfer member, thereby generating a first ghost image, the density detecting unit detecting the density level of the first ghost image; and the image formation level setting unit estimates a range of transfer bias levels, in which no first ghost image is generated, based on the first level and the ghost density level of the first ghost image, and sets the transfer bias level for forming images in the either one of the upstream image-forming unit to a minimum value in the range of transfer bias levels.

36. An image-forming device according to claim 28, wherein the image-forming unit includes a plurality of the image-forming units that are arranged in the relative movement direction;

wherein a developer image of the test pattern transferred onto the transfer member in one of at least one image-forming unit provided upstream of an image-forming unit provided farthest downstream in the relative movement direction is deposited on a photosensitive member in another image-forming unit that is located on the downstream side of the subject image-foiming unit and re-deposited in the non-test-image-forming region of the transfer member as a second ghost image;

the ghost generation level setting unit sets the transfer bias level applied between the transferring unit and photosensitive member in the another image-forming unit on the downstream side to the second level at which the second ghost image occurs;

the test pattern forming unit controls the another image-forming unit on the downstream side to form the developer image of the test pattern by applying a transfer bias of the second level to the transfer member, thereby generating the second ghost image, the density detecting unit detecting the density of the second ghost image; and the image formation level setting unit sets the transfer bias level for image formation in the another image-forming unit on the downstream side based on the second level and the ghost density level of the second ghost.

37. An image-forming device according to claim 28, wherein the image-forming unit includes a plurality of the image-forming units that are arranged in the relative movement direction;

wherein developer remaining on the photosensitive member in each image-forming unit after the transferring unit has transferred a developer image of the test pattern from the photosensitive member to the transfer member becomes deposited in the non-test-image-forming region as a first ghost, and a developer image that one of the image-forming unit provided upstream of the image-forming unit provided farthest downstream transfers onto the transfer member is deposited on the photosensitive member in the image-forming unit on the downstream side and re-deposited in the non-test-image-forming region of the transfer member as a second ghost, the ghost generation level setting unit sets, to the first level for generating the first ghost and the second level for generating the second ghost, the transfer bias level between the transferring unit and the photosensitive member in the image-forming unit on the downstream side of the image-forming unit provided farthest upward;

the test pattern forming unit controls the image-forming unit on the downstream side to form a developer image of a test pattern on the transfer member according to the first level, thereby generating a first test ghost in the non-test-image-forming region on the transfer member, and forms another developer image of the test pattern on the transfer member according to the second level, thereby generating a second test ghost in the non-test-image-forming region on the transfer member;

the density detecting unit detects both the first density level of the first test ghost and a second density level of the second test ghost; and the image formation level setting unit estimates a lower limit of a transfer bias level, in which no first ghost occurs, based on the first level and the first density level, estimates an upper limit of the transfer bias level, in which no second ghost occurs, based on the second level and the second density level, and sets the transfer bias level for forming images in the image-forming unit on the downstream side based on the upper limit and the lower limit.

38. An image-forming device according to claim 37, wherein the image formation level setting unit sets the transfer bias level for forming images in the image-forming unit on the downstream side to an intermediate value between the upper limit and the lower limit.

39. An image-forming device according to claim 38, wherein the image-forming unit on the downstream side is the image-forming unit farthest downstream among the plurality of image-forming unit.

40. An image-forming device according to claim 38, wherein the image-forming unit on the downstream side is the image-forming unit farthest downstream among the plurality of image-forming unit;

the ghost generation level setting unit sets the first level for generating the first ghost to the transfer bias level applied between the transferring unit and the photosensitive member in the image-forming unit on the upstream side of the farthest downstream image-forming unit, without setting the second level;

the test pattern forming unit controls the image-forming unit on the upstream side to form a developer image of the test pattern on the transfer member by applying a transfer bias set to the first level, thereby generating a first test ghost, without forming a developer image of the second test pattern corresponding to the second level; and the image formation level setting unit estimates a range of transfer bias levels, in which no first ghost occurs in the image-forming unit on the upstream side, based on the first level and the ghost density level of the first ghost, and sets the transfer bias level for forming images in the image-forming unit on the upstream side to the minimum value in the range of transfer bias levels for which no first ghost occurs.

41. An image-forming device according to claim 35, wherein the image formation level setting unit sets transfer bias levels independently for the plurality of image-forming units.

42. An image-forming device comprising:

an image-forming unit comprising:

a photosensitive member with an endless configuration having a predetermined circumference;

a charging unit that charges the photosensitive member;

an exposing unit that forms an electrostatic latent image on the photosensitive member;

a developing unit that develops the electrostatic latent image on the photosensitive member into a visible developer image; and a transferring unit that transfers the developer image onto a transfer member that moves in a relative movement direction with respect to the rotational direction of the photosensitive member at a predetermined transfer position;

a test pattern forming unit using the image-forming unit to form a developer image of test patterns on the photosensitive member;

a developer existence detecting unit that detects the existence of a developer on the photosensitive member after the developer image of the test patterns has been transferred from the photosensitive member to the transfer member; and an image-forming condition setting unit that sets image-forming conditions for at least one of the charging unit, the exposing unit, the developing unit, and the transferring unit based on detection results by the developer existence detecting unit, the test pattern forming unit periodically forming a plurality of test patterns arranged in the relative movement direction at a predetermined interval; and the image-forming condition setting unit determining that the developer exists on the photosensitive member when the developer existence detecting unit detects the developer at a period matching the test pattern forming interval.

* * * * *